US005811378A

United States Patent [19]

Lange

[11] Patent Number: 5,811,378

[45] Date of Patent: Sep. 22, 1998

[54] METAL CONTAINING DISPERSANT-VISCOSITY IMPROVERS FOR LUBRICATING OILS

[75] Inventor: Richard M. Lange, Euclid, Ohio

[73] Assignee: The Lubrizol Corporation, Wickliffe, Ohio

[21] Appl. No.: 786,156

[22] Filed: Jan. 21, 1997

[51] Int. Cl.[6] ..... C10M 159/18; C10M 149/00

[52] U.S. Cl. ..... 508/232; 508/221; 508/241; 508/362; 508/367

[58] Field of Search ..... 508/232, 367, 508/241, 221

[56] References Cited

U.S. PATENT DOCUMENTS

| | | | |
|---|---|---|---|
| 4,077,893 | 3/1978 | Kiovsky | 252/56 R |
| 4,141,847 | 2/1979 | Kiovsky | 252/51.5 A |
| 4,160,739 | 7/1979 | Stambaugh et al. | 508/232 |
| 4,169,063 | 9/1979 | Kiovsky | 252/51.5 A |
| 4,234,435 | 11/1980 | Meinhardt et al. | 508/232 |
| 4,517,104 | 5/1985 | Bloch et al. | 252/51.5 A |
| 4,632,769 | 12/1986 | Gutierrez et al. | 252/48.6 |
| 4,670,173 | 6/1987 | Hayashi et al. | 252/51.5 A |
| 4,803,003 | 2/1989 | Chung | 252/51.5 A |
| 5,035,821 | 7/1991 | Chung et al. | 252/51.5 A |
| 5,049,294 | 9/1991 | Van Zon et al. | 252/51.5 A |
| 5,210,146 | 5/1993 | Gutierrez et al. | 525/301 |
| 5,238,466 | 8/1993 | Gutierrez et al. | 508/232 |
| 5,266,223 | 11/1993 | Song et al. | 508/241 |
| 5,275,747 | 1/1994 | Gutierrez et al. | 508/241 |
| 5,277,833 | 1/1994 | Song et al. | 508/241 |
| 5,290,461 | 3/1994 | Chung et al. | 508/241 |
| 5,290,868 | 3/1994 | Chung et al. | 508/241 |
| 5,464,549 | 11/1995 | Sieberth | 508/232 |

FOREIGN PATENT DOCUMENTS

| | | | |
|---|---|---|---|
| 0352 670 B1 | 10/1992 | European Pat. Off. | C10M 143/02 |

OTHER PUBLICATIONS

Ranney, M.W., "Lubricant Additives", Noyes Data Corp. (1973) pp. 119–136.

Ranney, M.W., "Lubricant Additives, Recent Developments", Noyes Data Corp. (1978), pp. 151–159.

Ranney, M.W., "Synthetic Oils and Additives for Lubricants, Advances Since 1977", Noyes Data Corp. (1980), pp. 119–150.

*Primary Examiner*—Ellen M. McAvoy

*Attorney, Agent, or Firm*—Joseph P. Fischer; James L. Cordek

[57] ABSTRACT

A composition of matter suitable for use as a dispersant-viscosity improver for lubricating oil compositions comprises the reaction product of reactants comprising (a) a hydrocarbon polymer grafted with an α,β-ethylenically unsaturated carboxylic acid or functional derivative thereof, and (b) at least one nitrogen and metal containing derivative of a hydrocarbon substituted polycarboxylic acid or functional derivative thereof; and optionally (c) at least one hydroxyl-containing polyester containing at least one condensable free hydroxyl group.

50 Claims, No Drawings

METAL CONTAINING DISPERSANT-VISCOSITY IMPROVERS FOR LUBRICATING OILS

FIELD OF THE INVENTION

This invention relates to dispersant-viscosity improvers for lubricating oils, and oil compositions and concentrates containing such dispersant-viscosity improvers.

BACKGROUND OF THE INVENTION

The viscosity of lubricating oils, particularly the viscosity of mineral oil based lubricating oils, is generally dependent upon temperature. As the temperature of the oil is increased, the viscosity usually decreases.

The function of a viscosity improver is to reduce the extent of the decrease in viscosity as the temperature is raised or to reduce the extent of the increase in viscosity as the temperature is lowered, or both. Thus, a viscosity improver ameliorates the change of viscosity of an oil containing it with changes in temperature. The fluidity characteristics of the oil are improved.

Viscosity improvers are usually polymeric materials and are often referred to as viscosity index improvers.

Dispersants are also well-known in the lubricating art. Dispersants are employed in lubricants to keep impurities, particularly those formed during operation of mechanical devices such as internal combustion engines, automatic transmissions, etc. in suspension rather than allowing them to deposit as sludge or other deposits on the surfaces of lubricated parts.

Multifunctional additives that provide both viscosity improving properties and dispersant properties are likewise known in the art. Such products are described in numerous publications including Dieter Klamann, "Lubricants and Related Products", Verlag Chemie Gmbh (1984), pp 185–193; C. V. Smalheer and R. K. Smith "Lubricant Additives", Lezius-Hiles Co. (1967); M. W. Ranney, "Lubricant Additives", Noyes Data Corp. (1973), pp 92–145, M. W. Ranney, "Lubricant Additives, Recent Developments", Noyes Data Corp. (1978), pp 139–164; and M. W. Ranney, "Synthetic Oils and Additives for Lubricants", Noyes Data Corp. (1980), pp 96–166. Each of these publications is hereby expressly incorporated herein by reference.

Dispersant-viscosity improvers are generally prepared by functionalizing, i.e., adding polar groups, to a hydrocarbon polymer backbone.

Hayashi, et al, U.S. Pat. No. 4,670,173 relates to compositions suitable for use as dispersant-viscosity improvers made by reacting an acylating reaction product which is formed by reacting a hydrogenated block copolymer and an alpha-beta olefinically unsaturated reagent in the presence of free-radical initiators, then reacting the acylating product with a primary amine and optionally with a polyamine and a mono-functional acid.

Chung et al, U.S. Pat. No. 5,035,821 relates to viscosity index improver-dispersants comprised of the reaction products of an ethylene copolymer grafted with ethylenically unsaturated carboxylic acid moieties, a polyamine having two or more primary amino groups or polyol and a high functionality long chain hydrocarbyl substituted dicarboxylic acid or anhydride.

Van Zon et al, U.S. Pat. No. 5,049,294, relates to dispersant/VI improvers produced by reacting an alpha,beta-unsaturated carboxylic acid with a selectively hydrogenated star-shaped polymer then reacting the product so formed with a long chain alkane-substituted carboxylic acid and with a $C_1$ to $C_{18}$ amine containing 1 to 8 nitrogen atoms and/or with an alkane polyol having at least two hydroxy groups or with the performed product thereof.

Bloch et al, U.S. Pat. No. 4,517,104, relates to oil soluble viscosity improving ethylene copolymers reacted or grafted with ethylenically unsaturated carboxylic acid moieties then with polyamines having two or more primary amine groups and a carboxylic acid component or the preformed reaction product thereof.

Gutierrez et al, U.S. Pat. No. 4,632,769, describes oil-soluble viscosity improving ethylene copolymers reacted or grafted with ethylenically unsaturated carboxylic acid moieties and reacted with polyamines having two or more primary amine groups and a $C_{22}$ to $C_{28}$ olefin carboxylic acid component.

Each of these patents is hereby expressly incorporated herein by reference.

For additional disclosures concerning multi-purpose additives and particularly viscosity improvers and dispersants, the disclosures of the following United States patents are incorporated herein by reference:

| | | |
|---|---|---|
| 2,973,344 | 3,488,049 | 3,799,877 |
| 3,278,550 | 3,513,095 | 3,842,010 |
| 3,311,558 | 3,563,960 | 3,864,098 |
| 3,312,619 | 3,598,738 | 3,864,268 |
| 3,326,804 | 3,615,288 | 3,879,304 |
| 3,403,011 | 3,637,610 | 4,033,889 |
| 3,404,091 | 3,652,239 | 4,051,048 |
| 3,445,389 | 3,687,849 | 4,234,435 |

It is a primary object of this invention to provide novel multi-purpose lubricant additives.

It is a particular object to provide lubricant additives having a novel molecular microstructure.

A more specific object is to provide multi-purpose additives directed to improving lubricant viscosities and dispersancy properties.

A further object is to provide processes for preparing such multi-purpose additives.

Still another object is to provide lubricants having improved dispersancy and viscosity properties.

Other objects will in part be obvious in view of this disclosure and will in part appear hereinafter.

SUMMARY OF THE INVENTION

According to the present invention a composition of matter suitable for use as a dispersant-viscosity improver for lubricating oil compositions comprises the reaction product of reactants comprising (a) a hydrocarbon polymer grafted with an α,β-ethylenically unsaturated carboxylic acid or functional derivative thereof; and (b) at least one nitrogen and metal containing derivative of a hydrocarbon substituted polycarboxylic acid or functional derivative thereof selected from the group consisting of (b-i) amide and imide derivatives of metal salts and (b-ii) metal complexes of non-acidic acylated nitrogen compounds; and optionally, (c) at least one hydroxyl-containing polyester containing at least one condensable free hydroxyl group.

DETAILED DESCRIPTION OF THE PREFERRED EMBODIMENTS

As used herein, the terms "hydrocarbon", "hydrocarbyl" or "hydrocarbon based" mean that the group being described has predominantly hydrocarbon character within the context of this invention. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this invention, these groups may contain atoms other than carbon present in a chain or ring otherwise composed of carbon atoms.

In general, no more than about three non-hydrocarbon substituents or hetero atoms, and preferably no more than one, will be present for every 10 carbon atoms in the hydrocarbon or hydrocarbon based groups. Most preferably, the groups are purely hydrocarbon in nature, that is, they are essentially free of atoms other than carbon and hydrogen.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated, in a lubricating oil composition. For a further discussion of the terms oil soluble and dispersible, particularly "stably dispersible", see U.S. Pat. No. 4,320,019 which is expressly incorporated herein by reference for relevant teachings in this regard.

The Grafted Hydrocarbon Polymer

Reactant (a) is a hydrocarbon polymer grafted with an α,β-ethylenically unsaturated carboxylic acid or functional derivative thereof. For purposes of this invention, one carbonyl equivalent of (a) is that amount of (a) corresponding to the quotient of the average molecular weight of (a) divided by the number of carbonyl groups in (a) which are capable of reacting with one equivalent of metal.

The Hydrocarbon Polymer

As used herein, the expression 'polymer' refers to polymers of all types, i.e., homopolymers and copolymers. The term homopolymer refers to polymers derived from essentially one monomeric species; copolymers are defined herein as being derived from 2 or more monomeric species.

The hydrocarbon polymer is an essentially hydrocarbon based polymer, usually one having a number average molecular weight ($\overline{M}_n$) between 20,000 and 500,000, often from about 20,000 to about 300,000. Molecular weights of the polymeric hydrocarbon polymer are determined using well known methods described in the literature. Examples of procedures for determining the molecular weights are gel permeation chromatography (GPC) (also known as size-exclusion chromatography) and vapor phase osmometry (VPO). These and other procedures are described in numerous publications including:

P. J. Flory, "Principles of Polymer Chemistry", Cornell University Press (1953), Chapter VII, pp 266–316, and "Macromolecules, an Introduction to Polymer Science", F. A. Bovey and F. H. Winslow, Editors, Academic Press (1979), pp 296–312.

W. W. Yau, J. J. Kirkland and D. D. Bly, "Modern Size Exclusion Liquid Chromatography", John Wiley and Sons, New York, 1979.

A measurement which is complementary to a polymer's molecular weight is the melt index (ASTM D-1238). Polymers of high melt index generally have low molecular weight, and vice versa. The grafted polymers of the present invention preferably have a melt index of up to 20 dg/min., more preferably 0.1 to 10 dg/min.

These publications are hereby incorporated by reference for relevant disclosures contained therein relating to the determination of molecular weight.

When the molecular weight of a polymer is greater than desired, it may be reduced by techniques known in the art. Such techniques include mechanical shearing of the polymer employing masticators, ball mills, roll mills, extruders and the like. Oxidative or thermal shearing or degrading techniques are also useful and are known. Details of numerous procedures for shearing polymers are given in U.S. Pat. No. 5,348,673 which is hereby incorporated herein by reference for relevant disclosures in this regard.

The polymer may contain aliphatic, aromatic or cycloaliphatic components, or mixtures thereof. The hydrocarbon polymer is often hydrogenated to such an extent that the resulting hydrogenated polymer has olefinic unsaturation, based on the total number of carbon to carbon bonds in the polymer, of less than 5%. Preferably, the hydrogenated polymer will contain less than 2%, more preferably no more than 1% residual unsaturation. Most preferably, the hydrocarbon polymer is exhaustively hydrogenated. Aromatic unsaturation is not considered olefinic unsaturation within the context of this invention. Depending on hydrogenation conditions, up to about 20% of aromatic groups may be hydrogenated; however, typically no more than about 5%, usually less than 1% of aromatic bonds are hydrogenated. Most often, substantially none of the aromatic bonds are hydrogenated.

In preferred embodiments, the hydrocarbon polymer is an oil soluble or dispersible homopolymer or copolymer selected from the group consisting of (1) hydrogenated polymers of dienes;
(2) hydrogenated copolymers of conjugated dienes with vinyl substituted aromatic compounds;
(3) polymers of alpha-olefins having from 2 to about 28 carbon atoms;
(4) olefin-diene copolymers; and
(5) star polymers.

These preferred polymers are described in greater detail hereinbelow.

(1) Hydrogenated Polymers of Dienes

The hydrocarbon polymer may be a hydrogenated homopolymer or copolymer of one or more dienes. The dienes may be conjugated such as isoprene, butadiene and piperylene or non-conjugated such as 1–4 hexadiene and dicyclopentadiene. Polymers of conjugated dienes are preferred. Such polymers are conveniently prepared via free radical and anionic polymerization techniques. Emulsion techniques are commonly employed for free radical polymerization.

Hydrogenation is usually accomplished employing catalytic methods. Catalytic techniques employing hydrogen under high pressure and at elevated temperature are well-known to those skilled in the chemical art.

Extensive discussions of hydrogenated diene polymers appear in the "Encyclopedia of Polymer Science and Engineering", Volume 2, pp 550–586 and Volume 8, pp 499–532, Wiley-Interscience (1986), which are hereby expressly incorporated herein by reference for relevant disclosures in this regard.

Hydrogenated polymers include homopolymers and copolymers of conjugated dienes including polymers of 1,3-dienes of the formula

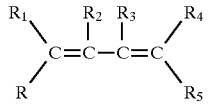

wherein each substituent denoted by R, or R with a numerical subscript, is independently hydrogen or hydrocarbon based, wherein hydrocarbon based is as defined hereinabove. Preferably at least one substituent is H. Normally, the total carbon content of the diene will not exceed 20 carbons. Preferred dienes for preparation of the polymer are piperylene, isoprene, 2,3-dimethyl-1,3-butadiene, chloroprene and 1,3-butadiene.

Suitable homopolymers of conjugated dienes are described, and methods for their preparation are given in numerous U.S. patents, including the following:

U.S. Pat. No. 3,547,821

U.S. Pat. No. 3,835,053

U.S. Pat. No. 3,959,161

U.S. Pat. No. 3,965,019

U.S. Pat. No. 4,085,055

U.S. Pat. No. 4,116,917

As a specific example, U.S. Pat. No. 3,959,161 teaches the preparation of hydrogenated polybutadiene. In another example, upon hydrogenation, 1,4-polyisoprene becomes an alternating copolymer of ethylene and propylene.

Copolymers of conjugated dienes are prepared from two or more conjugated dienes. Useful dienes are the same as those described in the preparation of homopolymers of conjugated dienes hereinabove. The following U.S. Patents describe diene copolymers and methods for preparing them:

U.S. Pat. No. 3,965,019

U.S. Pat. No. 4,073,737

U.S. Pat. No. 4,085,055

U.S. Pat. No. 4,116,917

For example, U.S. Pat. No. 4,073,737 describes the preparation and hydrogenation of butadiene-isoprene copolymers.

(2) Hydrogenated Copolymers of Conjugated Dienes with Vinyl Substituted Aromatic Compounds In one embodiment, the hydrocarbon polymer is a hydrogenated copolymer of a vinyl-substituted aromatic compound and a conjugated diene. The vinyl substituted aromatics generally contain from 8 to about 20 carbons, preferably from 8 to 12 carbon atoms and most preferably, 8 or 9 carbon atoms.

Examples of vinyl substituted aromatics include vinyl anthracenes, vinyl naphthalenes and vinyl benzenes (styrenic compounds). Styrenic compounds are preferred, examples being styrene, alpha-methystyrene, ortho-methyl styrene, meta-methyl styrene, para-methyl styrene, para-tertiary-butylstyrene, with styrene being preferred.

The conjugated dienes generally have from 4 to about 10 carbon atoms and preferably from 4 to 6 carbon atoms. Example of conjugated dienes include piperylene, 2,3-dimethyl-1,3-butadiene, chloroprene, isoprene and 1,3-butadiene, with isoprene and butadiene being particularly preferred. Mixtures of such conjugated dienes are useful.

The vinyl substituted aromatic content of these copolymers is typically in the range of about 20% to about 70% by weight, preferably about 40% to about 60% by weight. The aliphatic conjugated diene content of these copolymers is typically in the range of about 30% to about 80% by weight, preferably about 40% to about 60% by weight.

The polymers, and in particular, styrene-diene copolymers, can be random copolymers, regular block copolymers or random block copolymers. Random copolymers are those in which the comonomers are randomly, or nearly randomly, arranged in the polymer chain with no significant blocking of homopolymer of either monomer. Regular block copolymers are those in which a small number of relatively long chains of homopolymer of one type of monomer are alternately joined to a small number of relatively long chains of homopolymer of another type of monomer. Random block copolymers are those in which a larger number of relatively short segments of homopolymer of one type of monomer alternate with relatively short segments of homopolymer of another monomer.

The random, regular block and random block polymers used in this invention may be linear, or they may be partially or highly branched. The relative arrangement of homopolymer segments in a linear regular block or random block polymer is obvious. Differences in structure lie in the number and relative sizes of the homopolymer segments; the arrangement in a linear block polymer of either type is always alternating in homopolymer segments.

Normal or regular block copolymers usually have from 1 to about 5, often 1 to about 3, preferably only from 1 to about 2 relatively large homopolymer blocks of each monomer. Thus, a linear regular diblock copolymer of styrene or other vinyl aromatic monomer (A) and diene (B) would have a general structure represented by a large block of homopolymer (A) attached to a large block of homopolymer (B), as:

$(A)_a(B)_b$ where a and b are as described hereinbelow. Techniques vary for the preparation of these "A-B-A" and "B-A-B" triblock polymers, and are described in the literature for anionic polymerization.

Similarly, a regular linear tri-block copolymer of styrene or other vinyl aromatic monomer (A) and diene monomer (B) may be represented, for example, by $(A)_a(B)_b(C)_c$.

The third monomer (C) may be incorporated into linear, regular block copolymers. Several configurations are possible depending on how the homopolymer segments are arranged with respect to each other. For example, linear triblock copolymers of monomers (A),(B) and (C) can be represented by the general configurations:

$(A)_a$—$(B)_b$—$(C)_c$, $(A)_a$—$(C)_c$—$(B)_b$, or $(B)_b$—$(A)_a$—$(C)_c$, wherein the lower case letters a, b and c represent the approximate number of monomer units in the indicated block.

The sizes of the blocks are not necessarily the same, but may vary considerably. The only stipulation is that any regular block copolymer comprises relatively few, but relatively large, alternating homopolymer segments.

As an example, when (A) represents blocks derived from diene such as isoprene or butadiene, "a" usually ranges from about 100 to about 2000, preferably from about 500 to about 1500; when (B) represents, for example, blocks derived from styrene, "b" usually ranges from about 100 to about 2000, preferably from about 200 to about 1000; and when a third block (C) is present, "c" usually ranges from about 10 to about 1000, provided that the $\overline{M}_n$ of the polymer is within the ranges indicated as useful for this invention.

The copolymers can be prepared by methods well known in the art. Such copolymers usually are prepared by anionic polymerization using Group Ia metals in the presence of electron-acceptor aromatics, or preformed organometallics such as sec-butyllithium as polymerization catalysts.

The styrene/diene block polymers are usually made by anionic polymerization, using a variety of techniques, and altering reaction conditions to produce the most desirable features in the resulting polymer. In an anionic polymerization, the initiator can be either an organometallic material such as an alkyl lithium, or the anion formed by electron transfer from a Group Ia metal to an aromatic material such as naphthalene. A preferred organometallic material is an alkyl lithium such as sec-butyl lithium; the polymerization is initiated by addition of the butyl anion to either the diene monomer or to the styrene.

When an alkyl lithium initiator is used, a homopolymer of one monomer, e.g., styrene, can be selectively prepared, with each polymer molecule having an anionic terminus, and lithium gegenion. The carbanionic terminus remains an active initiation site toward additional monomers. The resulting polymers, when monomer is completely depleted, will usually all be of similar molecular weight and composition, and the polymer product will be "monodisperse" (i.e., the ratio of weight average molecular weight to number average molecular weight is very nearly 1.0). At this point, addition of 1,3-butadiene, isoprene or other suitable anionically polymerizable monomer to the homopolystyrene-lithium "living" polymer produces a second segment which grows from the terminal anion site to produce a living diblock polymer having an anionic terminus, with lithium gegenion.

Subsequent introduction of additional styrene can produce a new poly A-block-poly B-block-poly A, or A—B—A triblock polymer; higher orders of block polymers can be made by consecutive stepwise additions of different monomers in different sequences.

Alternatively, a living diblock polymer can be coupled by exposure to an agent such as a dialkyl dichlorosilane. When the carbanionic "heads" of two A—B diblock living polymers are coupled using such an agent, precipitation of LiCl occurs to give an A—B—A triblock polymer.

Block copolymers made by consecutive addition of styrene to give a relatively large homopolymer segment (A), followed by a diene to give a relatively large homopolymer segment (B), are referred to as poly-A-block-poly-B copolymers, or A—B diblock polymers.

When metal naphthalide is employed as initiator, the dianion formed by electron transfer from metal, e.g., Na, atoms to the naphthalene ring can generate dianions which may initiate polymerization, e.g. of monomer A, in two directions simultaneously, producing essentially a homopolymer of A having anionic termini at both ends.

Subsequent exposure of the poly (A) dianion to a second monomer (B) results in formation of a poly B-block-polyA-block-polyB, or a B—A—B triblock polymeric dianion, which may continue to interact with additional anionically-polymerizable monomers of the same, or different chemical type, in the formation of higher order block polymers. Ordinary block copolymers are generally considered to have up to about 5 such blocks.

Usually, one monomer or another in a mixture will polymerize faster, leading to a segment that is richer in that monomer, interrupted by occasional incorporation of the other monomer. This can be used to build a type of polymer referred to as a "random block polymer", or "tapered block polymer. When a mixture of two different monomers is anionically polymerized in a non-polar paraffinic solvent, one will initiate selectively, and usually polymerize to produce a relatively short segment of homopolymer. Incorporation of the second monomer is inevitable, and this produces a short segment of different structure. Incorporation of the first monomer type then produces another short segment of that homopolymer, and the process continues, to give a "random" alternating distribution of relatively short segments of homopolymers, of different lengths. Random block polymers are generally considered to be those comprising more than 5 such blocks. At some point, one monomer will become depleted, favoring incorporation of the other, leading to ever longer blocks of homopolymer, resulting in a "tapered block copolymer".

An alternative way of preparing random or tapered block copolymers involves initiation of styrene, and interrupting with periodic, or step, additions of diene monomer. The additions are programmed according to the relative reactivity ratios and rate constants of the styrene and particular diene monomer.

"Promoters" are electron-rich molecules that facilitate anionic initiation and polymerization rates while lessening the relative differences in rates between various monomers. Promoters also influence the way in which diene monomers are incorporated into the block polymer, favoring 1,2-polymerization of dienes over the normal 1,4-cis- addition.

Hydrogenation of the unsaturated block polymers initially obtained produces polymers that are more oxidatively and thermally stable. Techniques for accomplishing hydrogenation are well known to those of skill in the art. Briefly, hydrogenation is accomplished by contacting the copolymers with hydrogen at superatmospheric pressures in the presence of a metal catalyst such as colloidal nickel, palladium supported on charcoal, etc. and may be carried out as part of the overall production process, using finely divided, or supported, nickel catalyst. Other transition metals may also be used to effect the transformation. Hydrogenation is normally carried out to reduce approximately 94–96% of the olefinic unsaturation of the initial polymer. In general, it is preferred that these copolymers, for reasons of oxidative stability, contain no more than about 10%, preferably no more than 5% and more preferably no more than about 0.5% residual olefinic unsaturation on the basis of the total amount of olefinic double bonds present in the polymer prior to hydrogenation. Such unsaturation can be measured by a number of means well known to those of skill in the art, such as infrared or nuclear magnetic resonance spectroscopy. Most preferably, these copolymers contain no significant olefinic unsaturation. Aromatic unsaturation is not considered to be olefinic unsaturation within the context of this invention.

Other polymerization techniques such as emulsion polymerization can be used.

Often the arrangement of the various homopolymer blocks is dictated by the reaction conditions such as catalyst and polymerization characteristics of the monomers employed. Conditions for modifying arrangement of polymer blocks are well known to those of skill in the polymer art. Literature references relating to polymerization techniques and methods for preparing certain types of block polymers include:

1) "Encyclopedia of Polymer Science and Engineering", Wiley-Interscience Publishing, New York, (1986);
2) A. Noshay and J. E. McGrath, "Block Copolymers", Academic Press, New York, (1977);
3) R. J. Ceresa, ed., "Block and Graft Copolymerization", John Wiley and Sons, New York, (1976); and
4) D. J. Meier, ed., (Block Copolymers", MMI Press, Harwood Academic Publishers, New York, (1979).

Each of these is hereby incorporated herein by reference for relevant disclosures relating to block copolymers.

Examples of suitable commercially available regular linear diblock copolymers as set forth above include Shellvis-40, and Shellvis-50, both hydrogenated styrene-isoprene block copolymers, manufactured by Shell Chemical.

Examples of commercially available random block and tapered block copolymers include the various Glissoviscal styrene-butadiene copolymers manufactured by BASF. A previously available random block copolymer was PhilAd viscosity improver, manufactured by Phillips Petroleum.

The copolymers preferably have number average molecular weights ($\overline{M}_n$) in the range of about 20,000 to about 500,000, more preferably from about 30,000 to about 150,000. The weight average molecular weight ($\overline{M}_w$) for these copolymers is generally in the range of about 50,000 to about 500,000, preferably from about 50,000 to about 300,000.

Copolymers of conjugated dienes with olefins containing aromatic groups, e.g., styrene, methyl styrene, etc. are described in numerous patents including the following:

| | |
|---|---|
| 3,554,911 | 4,082,680 |
| 3,992,310 | 4,085,055 |
| 3,994,815 | 4,116,917 |
| 4,031,020 | 4,136,048 |
| 4,073,738 | 4,145,298 |
| 4,077,893 | |

For example, U.S. Pat. No. 3,554,911 describes a hydrogenated random butadiene-styrene copolymer, its preparation and hydrogenation.

(3) Polymers of Alpha-Olefins

Another hydrocarbon polymer onto which acid functionality is grafted is a polymer, a polyolefin, which consists in its main chain essentially of olefin, especially alpha olefin, monomers. The polyolefins of this embodiment thus exclude polymers which have a large component of other types of monomers copolymerized in the main polymer backbone, such as ester monomers, acid monomers, and the like. The polyolefin may contain impurity amounts of such materials, e.g., less than 5% by weight, more often less than 1% by weight, preferably, less than 0.1% by weight of other monomers. Useful polymers include oil soluble or dispersible substantially saturated, including hydrogenated, polymers of alpha-olefins. By substantially saturated is meant that no more than about 5% of the carbon to carbon bonds in the polymer are unsaturated. Preferably, no more than 1% are unsaturated, more preferably, the polymer is essentially free of unsaturation.

These polymers are preferably copolymers, more preferably copolymers of ethylene and at least one other α-olefin having from 3 to about 28 carbon atoms, i.e., one of the formula $CH_2{=}CHR_1$ wherein $R_1$ is straight chain or branched chain alkyl radical comprising 1 to 26 carbon atoms. Preferably $R_1$ in the above formula is alkyl of from 1 to 8 carbon atoms, and more preferably is alkyl of from 1 to 2 carbon atoms.

The ethylene content is preferably in the range of 20 to 80 percent by weight, and more preferably 30 to 70 percent by weight. When propylene and/or 1-butene are employed as comonomer(s) with ethylene, the ethylene content of such copolymers is most preferably 45 to 65 percent, although higher or lower ethylene contents may be present. Most preferably, these polymers are substantially free of ethylene homopolymer, although they may exhibit a degree of crystallinity due to the presence of small crystalline polyethylene segments within their microstructure. Preferred polymers are copolymers of ethylene and propylene and ethylene and 1-butene.

The alpha olefin copolymer preferably has a number average molecular weight ($\overline{M}_n$) determined by gel-permeation chromatography employing polystyrene standards, ranging from about 30,000 to about 300,000, more often from about 50,000 to about 150,000, even more often from about 80,000 to 150,000. Exemplary polydispersity values ($\overline{M}_w/\overline{M}_n$) range from about 2.2 to about 2.5.

The polymers employed in this embodiment may generally be prepared substantially in accordance with procedures which are well known in the art. The polymers for use in this embodiment can be prepared by polymerizing monomer mixtures comprising alpha-olefins. The monomers are alpha-olefins containing from 2 to about 28 carbon atoms, and may be branched chain or linear. In a preferred embodiment, one monomer is ethylene, the comonomer being at least one $C_{3-28}$ alpha olefin, preferably $C_{3-8}$ alpha olefins, including monoolefins such as propylene, 1-butene, isobutene, 1-pentene, 1-hexene, 1-heptene, 1-octene, 1-nonene, 1-decene, propylene tetramer, diisobutylene, and triisobutylene.

Catalysts employed in the production of the reactant polymers are likewise well known. One broad class of catalysts particularly suitable for polymerization of α-olefins, comprises coordination catalysts such as Ziegler or Ziegler-Natta catalysts comprising a transition metal atom. Ziegler-Natta catalysts are composed of a combination of a transition metal atom with an organo aluminum halide and may be used with additional complexing agents.

Polymerization using coordination catalysis is generally conducted at temperatures ranging between 20° and 300° C., preferably between 30° and 200° C. Reaction time is not critical and may vary from several hours or more to several minutes or less, depending upon factors such as reaction temperature, the monomers to be copolymerized, and the like. One of ordinary skill in the art may readily obtain the optimum reaction time for a given set of reaction parameters by routine experimentation. Preferably, the polymerization will generally be completed at a pressure of 1 to 40 MPa (10 to 400 bar).

The polymerization may be conducted employing liquid monomer, such as liquid propylene, or mixtures of liquid monomers (such as mixtures of liquid propylene and 1-butene), as the reaction medium. Alternatively, polymerization may be accomplished in the presence of a hydrocarbon inert to the polymerization such as butane, pentane, isopentane, hexane, isooctane, decane, toluene, xylene, and the like.

When carrying out the polymerization in a batch-type fashion, the reaction diluent (if any) and the alpha-olefin comonomer(s) are charged at appropriate ratios to a suitable reactor. Care should be taken that all ingredients are dry, with the reactants typically being passed through molecular sieves or other drying means prior to their introduction into the reactor. Subsequently, component(s) of the catalyst are introduced while agitating the reaction mixture, thereby causing polymerization to commence. Alternatively, component(s) of the catalyst may be premixed in a solvent and then fed to the reactor. As polymer is being formed, additional monomers may be added to the reactor. Upon completion of the reaction, unreacted monomer and solvent are either flashed or distilled off, if necessary by vacuum, and the copolymer withdrawn from the reactor.

The polymerization may be conducted in a continuous manner by simultaneously feeding the reaction diluent (if employed), monomers, component(s) of the catalyst to a reactor and withdrawing solvent, unreacted monomer and polymer from the reactor so as to allow a residence time of ingredients long enough for forming polymer of the desired molecular weight; and separating the polymer from the reaction mixture.

In those situations wherein the molecular weight of the polymer product that would be produced at a given set of operating conditions is higher than desired, any of the techniques known in the prior art for control of molecular weight, such as the use of hydrogen and/or polymerization temperature control, may be used.

However, the polymers are preferably formed in the substantial absence of added $H_2$ gas, that is $H_2$ gas added in amounts effective to substantially reduce the polymer molecular weight.

The polymers can be random copolymers, block copolymers, and random block copolymers. Ethylene propylene copolymers are usually random copolymers Numerous United States patents, including the following, describe the preparation of copolymers of alpha olefins.

| | |
|---|---|
| 3,513,096 | 4,068,057 |
| 3,551,336 | 4,081,391 |
| 3,562,160 | 4,089,794 |
| 3,607,749 | 4,098,710 |
| 3,634,249 | 4,113,636 |
| 3,637,503 | 4,132,661 |
| 3,992,310 | 4,137,185 |
| 4,031,020 | 4,138,370 |
| 4,068,056 | 4,144,181 |

Copolymers of ethylene with higher alpha olefins are the most common copolymers of aliphatic olefins and ethylene-propylene copolymers are the most common ethylene-alpha-olefin copolymers and are preferred for use in this invention. A description of an ethylene-propylene copolymer appears in U.S. Pat. No. 4,137,185 which is hereby incorporated herein by reference.

Useful ethylene-alpha olefin, usually ethylene-propylene, copolymers are commercially available from numerous sources including the Exxon, Texaco and Lubrizol Corporations.

(4) Olefin-Diene Copolymers

Another useful hydrocarbon polymer is one derived from olefins, especially lower olefins, and dienes. Dienes may be non-conjugated or conjugated. Useful olefins and dienes are the same as those described hereinabove and hereinafter in discussions of other polymer types.

In one embodiment, the copolymer is an ethylene-lower olefin-diene copolymer. As used herein, the term lower refers to groups or compounds containing no more than 8 carbon atoms. Preferably, the diene is non-conjugated.

There are numerous commercial sources for lower olefin-diene copolymers. For example, Ortholeum® 2052 (a product marketed by the DuPont Company) which is a terpolymer having an ethylene:propylene weight ratio of about 57:43 and containing 4–5 weight % of groups derived from 1–4 hexadiene monomer, and numerous other such materials are readily available. Olefin-dienes copolymers and methods for their preparation are described in numerous patents including the following U.S. Patents:

U.S. Pat. No. 3,291,780
U.S. Pat. No. 3,300,459
U.S. Pat. No. 3,598,738
U.S. Pat. No. 4,026,809
U.S. Pat. No. 4,032,700
U.S. Pat. No. 4,156,061
U.S. Pat. No. 3,320,019
U.S. Pat. No. 4,357,250

U.S. Pat. No. 3,598,738, which describes the preparation of ethylene-propylene-1,4-hexadiene terpolymers, is illustrative. This patent also lists numerous references describing the use of various polymerization catalysts.

Another useful polymer is an olefin-conjugated diene copolymer. An example of such a polymer is butyl rubber, an isobutylene-isoprene copolymer.

Details of various types of polymers, reaction conditions, physical properties, and the like are provided in the above patents and in numerous books, including:

"Riegel's Handbook of Industrial Chemistry", 7th edition, James A. Kent Ed., Van Nostrand Reinhold Co., New York (1974), Chapters 9 and 10, P. J. Flory, "Principles of Polymer Chemistry", Cornell University Press, Ithaca, N.Y. (1953), "Kirk-Othmer Encyclopedia of Chemical Technology", 3rd edition, Vol. 8 (Elastomers, Synthetic, and various subheadings thereunder), John Wiley and Sons, New York (1979).

Each of the above-mentioned books and patents is hereby expressly incorporated herein by reference for relevant disclosures contained therein.

Polymerization can also be effected using free radical initiators in a well-known process, generally employing higher pressures than used with coordination catalysts.

(5) Star Polymer

Star polymers are polymers comprising a nucleus and polymeric arms. Common nuclei include polyalkenyl compounds, usually compounds having at least two non-conjugated alkenyl groups, usually groups attached to electron withdrawing groups, e.g., aromatic nuclei. The polymeric arms are often homopolymers and copolymers of conjugated dienes and monoalkenyl arenes and mixtures thereof.

The polymers thus comprise a poly(polyalkenyl coupling agent) nucleus with polymeric arms extending outward therefrom. The star polymers are usually hydrogenated such that at least 80% of the covalent carbon—carbon bonds are saturated, more often at least 90% and even more preferably, at least 95% are saturated.

The polyvinyl compounds making up the nucleus are illustrated by polyalkenyl arenes, e.g., divinyl benzene and poly vinyl aliphatic compounds.

Dienes making up the polymeric arms are illustrated by, butadiene, isoprene and the like. Monoalkenyl compounds include, for example, styrene and alkylated derivatives thereof.

Star polymers are well known in the art. Such material and methods for preparing same are described in numerous publications and patents, including the following United States patents which are hereby incorporated herein by reference for relevant disclosures contained therein:

U.S. Pat. No. 4,116,917,
U.S. Pat. No. 4,141,847,
U.S. Pat. No. 4,346,193,
U.S. Pat. No. 4,358,565,
and U.S. Pat. No. 4,409,120.

Star polymers are commercially available, for example as Shellvis 200 sold by Shell Chemical Co.

The Ethylenically Unsaturated Carboxylic Acid or Functional Derivative Thereof The ethylenically unsaturated carboxylic acids or functional derivatives are well know in the art. The most commonly used materials contain from to about 20 carbon atoms exclusive of carbonyl carbons. They include such acids as acrylic acid, methacrylic acid, maleic acid, fumaric acid, crotonic acid, citraconic acid, itaconic acid and mesaconic acid, as well as their anhydrides, halides and esters (especially the lower alkyl esters, the term "lower alkyl" meaning alkyl groups having up to 7 carbon atoms). The preferred compounds are the alpha-beta-olefinic carboxylic acids, especially those containing at least two carboxy groups and more especially dicarboxylic acids, and their derivatives. Maleic acid and maleic anhydride, especially the latter, are particularly preferred.

Reactant (a) is prepared by grafting, either by mastication of the neat polymer, or in solution, the ethylenically unsaturated carboxylic acid or functional derivative onto the ethylene copolymer backbone employing techniques that are well-known in the art. Free-radical grafting techniques are usually employed. Thermal grafting by the "ene" reaction using copolymers containing unsaturated sites, such as ethylene-propylene-diene copolymers may be employed.

The ethylenically unsaturated carboxylic acid is generally employed in amounts ranging from about 0.01% to 10% preferably 0.1–5%, more preferably 0.2–2% by weight, based on the weight of polymer.

Free Radical Generating Reagents

Radical grafting is preferably carried out using free radical initiators such as peroxides, hydroperoxides, and azo compounds which decompose thermally within the grafting temperature range to provide said free radicals.

Free radical generating reagents are well know to those skilled in the art. Examples include benzoyl peroxide, t-butyl perbenzoate, t-butyl metachloroperbenzoate, t-butyl peroxide, sec-butylperoxydicarbonate, azobisisobutyronitrile, and the like. Numerous examples of free radical-generating reagents, also known as free-radical initiators, are mentioned in the above-referenced tests by Flory and by Bovey and Winslow. An extensive listing of free-radical initiators appears in J. Brandrup and E. H. Immergut, Editor, "Polymer Handbook", 2nd edition, John Wiley and Sons, New York (1975), pages II-1 to II-40. Preferred free radical-generating reagents include t-butyl peroxide, t-butyl hydroperoxide, t-amyl peroxide, cumyl peroxide, t-butyl peroctoate, t-butyl-m-chloroperbenzoate and azobisisovaleronitrile.

The free radical initiators are generally used in an amount from 0.01 to about 10 percent by weight based on the total weight of the reactants. Preferably, the initiators are used at about 0.05 to about 1 percent by weight.

The grafting reaction is usually conducted at temperatures ranging between about 80° C. to about 200° C., preferably between about 130° C. to about 170° C. Considerations for determining reaction temperatures include reactivity of the system and the half-life of the initiator at a particular temperature.

The choice of free radical generating reagent can be an important consideration. For example, when a polymer undergoing grafting with a monomer is diluted with a solvent such as a hydrocarbon oil, grafting of the monomer onto the oil diluent may occur. It has been observed that the choice of initiator affects the extent of grafting of the monomer onto the oil diluent. Reducing the amount of monomer grafted onto the diluent usually results in an increased amount of monomer grafted onto the polymer backbone. Improved efficiency of monomer grafting onto olefinic copolymer resins has been described in U.S. Pat. No. 5,298,565 which is hereby incorporated herein by reference for relevant disclosures in this regard.

Azo group containing initiators, such as Vazo® polymerization initiators (DuPont) employed in the grafting process at about 95° C. result in a much higher degree of grafting onto the polymer backbone than do peroxide initiators such as t-butyl peroxide, employed at about 150°–160° C. Peresters are particularly effective in the free-radical grafting process.

Examples of grafted polymers are included hereinafter in examples of the dispersant-viscosity improvers of the invention.

(b) The Nitrogen-containing Metal Salt

Reactant (b) is a nitrogen and metal containing derivative of a polycarboxylic acid, preferably a succinic acid, or functional derivative thereof selected from the group consisting of (b-i) amide and imide derivatives of metal salts and (b-ii) metal complexes of non-acidic acylated nitrogen compounds.

Reactant (b) is preferably oil-soluble. Materials of this type are described by LeSuer in U.S. Pat. Nos. 3,163,603 and 3,306,908.

Reactant (b) may be prepared by the process which comprises reacting, at a temperature within the range of from about 20° C. to about 250° C., about two equivalents of a polycarboxylic compound selected from the class consisting of hydrocarbon-substituted polycarboxylic acids and anhydrides wherein the hydrocarbon substituent has at least about 8, preferably at least about 30, often at least about 50 carbon atoms, about one equivalent of a basic metal reactant selected from the class consisting of alkali metal, alkaline earth metal, lead, cadmium, titanium, tin, antimony, cerium, copper, zirconium and zinc oxides, hydroxides, carbonates and lower alcoholates and the successive combination of an alkali metal hydroxide and an inorganic metal salt selected from the class consisting of alkaline earth metal, lead, cadmium, zinc, nickel and cobalt halides and nitrates, and from one to about five equivalents of an amine selected from the class consisting of alkylene polyamines and hydroxy alkyl-substituted alkylene polyamines, each as described herein. In the usual case from about one to about two equivalents of amine is used.

In one embodiment, (b) is prepared by reacting one equivalent of a mono metal salt of a hydrocarbon substituted succinic acid with from about 1 to about 5 equivalents of an amine selected from the group consisting of alkylene polyamines and hydroxy alkyl substituted alkylene polyamines having up to eight carbon atoms in the alkylene radical and up to about 6 carbon atoms in the hydroxyalkyl group.

In another embodiment, (b) is prepared by reacting one equivalent of a hydrocarbon substituted succinic acid or anhydride with from 1 to about 5 equivalents of an amine selected from the group consisting of alkylene polyamines and hydroxy alkyl substituted alkylene polyamines having up to about 8 carbon atoms in the alkylene group and up to about 6 carbon atoms in the hydroxy alkyl group, heating to effect acylation, removing water to form an acylated amine then reacting the acylated polyamine with about one equivalent of a basic metal reactant described hereinabove and the successive combination of an alkali metal hydroxide and an inorganic metal salt consisting of alkaline earth metal, lead, cadmium, and zinc halides and nitrates.

The Polycarboxylic Compound

Suitable carboxylic acids or anhydrides are hydrocarbyl substituted, aromatic, cycloaliphatic and aliphatic, preferably oil-soluble acids. Polycarboxylic acids are defined herein as having 2 or more carboxyl groups. In one embodiment, the carboxylic acylating agent is characterized by the presence within its structure of from about 0.8 to about 2 succinic groups per hydrocarbyl substituent. Preferably the hydrocarbyl substituent is aliphatic and contains at least 30 carbon atoms, more preferably at least about 50 carbon atoms, up to about 200, more preferably, up to about 100 carbon atoms. In another embodiment the polycarboxylic compound comprises a mixture of hydrocarbyl substituted carboxylic acids or anhydrides wherein the mixture comprises aliphatic substituted carboxylic acids or anhydrides containing from about 12 to about 24 carbon atoms in the aliphatic substituent and aliphatic substituted carboxylic acids or anhydrides having at least about 40 carbon atoms in the aliphatic substituent. In another preferred embodiment, the acid or anhydride may contain from about 8 to 28 carbon atoms. When these are aliphatic acids, preferably predominantly linear acids, they tend to provide friction reducing characteristics to lubricating oils comprising the dispersant-viscosity improvers of this invention which incorporate such acids therein.

Useful acids may be illustrated by the general formula $$R—(COOH)_n \quad (II)$$

and the corresponding anhydrides, ester acids, or lactone acids thereof, wherein R is a hydrocarbyl group. R may be aliphatic, cycloaliphatic, or aromatic, including alkyl, alkenyl, aralkyl and alkaryl, including mixtures of acids containing aliphatic and aromatic groups. Preferably R is an aliphatic group containing from about 8 to about 750 carbon atoms, more preferably from 16 to about 200 carbon atoms, even more preferably from about 30 to about 100 carbon atoms. The subscript 'n' is a number ranging from 2 to about 10, preferably 2 to about 4, more preferably 2 or 3, especially 2. Preferred carboxylic acids include polyolefin substituted succinic acids, succinic anhydrides, ester acids or lactone acids. Mixtures of such acids are also useful.

Suitable dicarboxylic acids include the substituted succinic acids having the formula $$\begin{array}{l} R^4—CHCOOH \\ \quad\;\; | \\ \quad\;\; CH_2COOH \end{array}$$

wherein $R^4$ is the same as R as defined above. Also contemplated are the corresponding derivatives, the anhydrides, ester acids, or lactone acids of this succinic acid. $R^4$ is preferably an olefin polymer-derived group formed by polymerization of such monomers as ethylene, propylene, 1-butene, isobutene, 1-pentene, 2-pentene, 1-hexene and 3-hexene. Such groups usually contain from about 30 to about 200, more often up to about 100 carbon atoms. $R^4$ may also be derived from a high molecular weight substantially saturated petroleum fraction. The hydrocarbon-substituted succinic acids and their derivatives constitute the most preferred class of carboxylic acids.

Included among the useful carboxylic reactants are hydrocarbyl substituted cyclohexene dicarboxylic acids and anhydrides which may be obtained from the reaction of e.g., maleic anhydride with an olefin while the reaction mass is being treated with chlorine.

Patents describing useful aliphatic polycarboxylic acids or anhydrides and methods for preparing them include, among numerous others, U.S. Pat. Nos. 3,163,603 (LeSuer), 3,215,707 (Rense); 3,219,666 (Norman et al), 3,231,587 (Rense); 3,306,908 (LeSuer); 3,912,764 (Palmer); 4,110,349 (Cohen); and 4,234,435 (Meinhardt et al); and U.K. 1,440,219 which are hereby incorporated by reference for their disclosure of useful carboxylic reactants.

As indicated in the above-mentioned patents, which are hereby incorporated by reference for their disclosure of compounds useful as reactant (b-1) of this invention, the carboxylic acids (or various derivatives thereof) include those derived by the reaction of an alpha, beta-unsaturated carboxylic acid containing compound with a polyalkene or halogenated derivative thereof or a suitable olefin.

The polyalkenes from which the carboxylic acids reactants may be derived are homopolymers and interpolymers, also referred to herein as copolymers, of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer(s)", or "copolymers" as used herein is inclusive of polymers derived from two different monomers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., >C═C<); that is, they are monolefinic monomers such as ethylene, propylene, 1-butene, isobutene, and 1-octene or polyolefinic monomers (usually diolefinic monomers) such as 1,3-butadiene and isoprene.

These olefin monomers are usually polymerizable terminal olefins; that is, olefins characterized by the presence in their structure of the group $>C{=}CH_2$. However, polymerizable internal olefin monomers (sometimes referred to in the literature as medial olefins) characterized by the presence within their structure of the group $$—C—C{=}C—C—$$

can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, 1,3-pentadiene (i.e., piperylene) is deemed to be a terminal olefin for purposes of this invention.

Polypropylene and polybutylene, particularly polyisobutylene, are preferred. These typically have number average molecular weight ranging from about 300 to about 5,000, more often from about 700 to about 2,000.

Numerous polycarboxylic acids are commercially available, many from more than one source. The commercially available polycarboxylic acids can be used in the preparation of the compositions of this invention. While these commercially available polyacids, or derivatives thereof that contain the requisite hydrocarbyl substituent may be used by themselves, it is usually beneficial to employ them in combination with polyolefin substituted succinic acids, anhydrides or functional derivatives thereof. Those that do not contain the requisite hydrocarbyl substituent, must be used together with a substituted polycarboxylic acid, usually in amounts that do not exceed about 20 mole % of the total acid functionality. Such commercially available polycarboxylic acids and anhydrides include, but are not limited to aliphatic acids such as glutaric, adipic, sebacic, azaleic, dodecanedioic, 5-norbomene dicarboxylic, bicyclooctene dicarboxylic, 2-OH-succinic, citric, tartaric, cyclopentane tetracarboxylic, 5-norbornene-2,3-dicarboxylic, cyclohexene-4,5-dicarboxylic and cyclohexane dicarboxylic (1,2- 1,3-, and 1,4-). Also useful are aromatic acids and anhydrides such as phthalic, terephthalic, trimellitic anhydride, trimesic, pyromellitic, 2,3-naphthalene-dicarboxylic, 1,8-naphthalic, benzophenone tetracarboxylic, and 1,1,3-trimethyl-3-phenylindane-4',5'-dicarboxylic.

Polycarboxylic acids from vegetable- and animal-sourced carboxylic compounds can be used for preparing polyesters of this invention. Dimer acids, made by the thermal coupling of unsaturated vegetable acids, are available from Emery, Westvaco, Unichema and other companies. Polyacid reaction products of unsaturated vegetable acids with acrylic acid and maleic anhydride are available from Westvaco under the product names Diacid 1550 and Tenax 2010, respectively. Another useful vegetable derived acid is 12-hydroxystearic acid, which can provide both carboxyl and hydroxy functionality to the polyester.

Additionally, polyether alpha, omega-acids, such as 3,6,9-trioxaundecane-1,11-dioic acid and mixed polyether diacids available from Hoechst Chemie can also be incorporated into the hydroxy-containing polyesters to impart surface activity and polarity, and to affect morphology at low temperatures.

The above-described classes of carboxylic acids derived from olefin polymers, and their derivatives, are well known in the art, and methods for their preparation as well as representative examples of the types useful in the present invention are described in detail in the following U.S. patents:

| | | |
|---|---|---|
| 3,172,892 | 3,316,771 | 3,522,179 |
| 3,216,936 | 3,373,111 | 3,542,678 |
| 3,219,666 | 3,381,022 | 3,542,680 |
| 3,271,310 | 3,341,542 | 3,579,450 |
| 3,272,746 | 3,344,170 | 3,632,510 |
| 3,278,550 | 3,448,048 | 3,632,511 |
| 3,281,428 | 3,454,607 | 3,639,242 |
| 3,306,908 | 3,515,669 | |

Other useful acids are hydrocarbyl substituted aromatic polycarboxylic acids such as substituted phthalic acid, mellitic acids, and the like.

Non-limiting examples of polycarboxylic compounds include those in the following examples. Parts in the following examples are, unless otherwise indicated, parts by weight. Temperatures are in degrees Celsius (°C.). Filtrations employ a diatomaceous earth filter aid.

Example (b-1)-1

A mixture of 6400 parts (4 moles) of a polybutene comprising predominantly isobutene units and having a number average molecular weight of about 1600 and 408 parts (4.16 moles) of maleic anhydride is heated at 225°–240° C. for 4 hours. It is then cooled to 170° C. and an additional 102 parts (1.04 moles) of maleic anhydride is added, followed by 70 parts (0.99 mole) of chlorine; the latter is added over 3 hours at 170°–215° C. The mixture is heated for an additional 3 hours at 215° C. then vacuum stripped at 220° C. and filtered through diatomaceous earth. The product is the desired polybutenyl-substituted succinic anhydride having a saponification number of 61.8.

Example(b-1)-2

A polybutenyl succinic anhydride is prepared by the reaction of a chlorinated (4.3% Cl) polybutylene with maleic anhydride at 200° C. The polybutenyl radical contains an average of about 70 carbon atoms and contains primarily isobutene units. The resulting alkenyl succinic anhydride is found to have an acid number of 103.

Example (b-1)-3

A lactone acid is prepared by reacting 2 equivalents of a polyolefin ($\overline{M}_n$ about 900) substituted succinic anhydride with 1.02 equivalents of water at a temperature of about 90° C. in the presence of a catalytic amount of concentrated sulfuric acid. Following completion of the reaction, the sulfuric acid catalyst is neutralized with sodium carbonate and the reaction mixture is filtered.

Example (b-1)-4

An ester acid is prepared by reacting 2 equivalents of an alkyl substituted succinic anhydride having an average of about 35 carbon atoms in the alkyl group with 1 mole of ethanol.

Example (b-1)-5

A reactor is charged with 1000 parts of polybutene having a number average molecular weight determined by vapor phase osmometry of about 950 and which consists primarily of isobutene units, followed by the addition of 108 parts of maleic anhydride. The mixture is heated to 110° C. followed by the sub-surface addition of 100 parts $Cl_2$ over 6.5 hours at a temperature ranging from 110° to 188° C. The exothermic reaction is controlled as not to exceed 188° C. The batch is blown with nitrogen then stored.

Example (b-1)-6

A procedure similar to that of Example (b-1)-5 is repeated employing 1000 parts of polybutene having a molecular weight determined by vapor phase osmometry of about 1650 and consisting primarily of isobutene units and 106 parts maleic anhydride. $Cl_2$ (90 parts) is added beginning at 130° C. and added at a nearly continuous rate such that the maximum temperature of 188° C. is reached near the end of chlorination. The residue is blown with nitrogen and collected.

Example (b-1)-7

A reactor is charged with 1000 parts of $C_{18-24}$ olefin mixture obtained from Albamarle Corporation, Houston, Tex. The material is heated to 65° followed by addition of 350 parts maleic anhydride. The temperature is increased to 213° then held at reflux until the total acid number is between 285–295. The reactor contents are stripped to remove volatile materials until analysis shows % maleic acid is less than 0.30%

Example (b-1)-8

A reactor is charged with 1000 parts of a polybutene having a number average molecular weight of about 1500 and 47.9 parts molten maleic anhydride. The materials are heated to 138° C. followed by chlorination, allowing the temperature to rise to between 188°–191° C., heating and chlorinating until the acid number is between 43 and 49 (about 40–45 parts $Cl_2$ are utilized). The materials are heated at 224°–227° C. for about 2.5 hours until the acid number stabilizes. The reaction product is diluted with 438 parts mineral oil diluent and filtered with a diatomaceous earth filter aid.

The Metal Reactant

The metals of the metal salts useful in this invention are those metals selected from the class consisting of alkali metals, alkaline earth metals, zinc, cadmium, lead, cobalt, titanium, tin, antimony, cerium, zirconium, and nickel. Examples of metal compounds contemplated are the following: oxides, hydroxides, carbonates, methylates, propylates, pentylates, and phenoxides of sodium, potassium, lithium, calcium, barium, magnesium, zinc, cadmium, lead, nickel, titanium, antimony, cerium, cobalt, tin, etc. The above metal compounds are merely illustrative of those useful to prepare the metal salt (b) used in the invention are not to be considered as limited to such. A more extensive listing of useful metal compounds is provided in U.S. Pat. No. 3,163,603 which is expressly incorporated herein by reference.

It is preferred that chlorine-containing compounds are avoided. The presence of chlorine often tends to aggravate corrosion. Corrosion can generate metal-containing compounds which, in certain amounts, and under certain conditions, promote oxidation of organic materials. Such oxidation accelerates formation of sludge and other dirt forming materials thus placing an extra burden on the dispersant-viscosity improver.

Amounts of metal reactant are often referred to in terms of equivalents. An equivalent of metal is defined herein as the formula weight of the metal divided by its valence. Therefore, one equivalent of sodium is equal to its formula weight, one equivalent of zinc is equal to one-half of its formula weight, one equivalent of aluminum is one-third of its formula weight. Similarly for ions, one equivalent of cupric ion is its formula weight divided by 2, one equivalent of cuprous ion is its formula weight.

The Polyamine

The polyamine is an alkylene polyamine or a hydroxyalkyl substituted alkylene polyamine containing at least two basic nitrogen atoms and is characterized by the presence within its structure of at least one condensable —HN— group. Mixtures of two or more amino compounds can be used in the reaction. Preferably, the polyamine contains at least one primary amino group (i.e., $—NH_2$) and more preferably is a polyamine containing at least two condensable —NH— groups, either or both of which are primary or secondary amine groups. The amines may be aliphatic, cycloaliphatic, aromatic or heterocyclic amines.

Amounts of polyamines are often referred to in equivalents. One equivalent of a polyamino compound or derivative thereof is its formula weight divided by the average number of nitrogen atoms therein which contain a basic N—H group. Thus ethylene diamine contains 2 equivalents; N,N-dimethyl-propanediamine contains one equivalent.

Among the preferred amines are the alkylene polyamines, including the polyalkylene polyamines. The alkylene polyamines include those conforming to the formula $$\begin{array}{c} R^2N-(U-N)_n-R^2 \\ | \qquad\quad | \\ R^2 \qquad\quad R^2 \end{array}$$

wherein n is from 1 to about 10; each $R^2$ is independently a hydrogen atom, a hydrocarbyl group or a hydroxy-substituted or amine-substituted hydrocarbyl group having up to about 30 atoms, or two $R^2$ groups on different nitrogen atoms can be joined together to form a U group, with the proviso that at least one $R^2$ group is a hydrogen atom and U is an alkylene group of about 2 to 10 carbon atoms. Preferably U is ethylene or propylene. Especially preferred are the alkylene polyamines where each $R^2$ is hydrogen or an amino-substituted hydrocarbyl group with the ethylene polyamines and mixtures of ethylene polyamines being the most preferred. Usually n will have an average value of from 2 to about 7. Such alkylene polyamines include methylene polyamine, ethylene polyamines, butylene polyamines, propylene polyamines, pentylene polyamines, hexylene polyamines, heptylene polyamines, etc. The higher homologs of such amines and related amino alkyl-substituted piperazines are also included.

Alkylene polyamines useful in preparing the compositions of this invention include ethylene diamine, diethylene triamine, triethylene tetramine, propylene diamine, trimethylene diamine, hexamethylene diamine, decamethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene) triamine, N-(2-aminoethyl)piperazine, 1,4-bis(2-aminoethyl)piperazine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7 pages 27–39, Interscience Publishers, Division of John Wiley and Sons, 1965, and in Meinhardt et al, U.S. Pat. No. 4,234,435, both of which are hereby incorporated by reference for the disclosure of useful polyamines. Such compounds are prepared most conveniently by the reaction of an alkylene dichloride with ammonia or by reaction of an ethylene imine with a ring-opening reagent such as ammonia, etc. These reactions result in the production of the somewhat complex mixtures of alkylene polyamines, including cyclic condensation products such as piperazines. The mixtures are particularly useful. On the other hand, quite satisfactory products can also be obtained by the use of pure alkylene polyamines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than two, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex. designated "E-100" showed a specific gravity at 15.6° C. of 1.0168, a percent nitrogen by weight of 33.15 and a viscosity at 40° C. of 121 centistokes. Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher linear and branched analogs of diethylenetriamine, triethylenetetramine and the like.

In another embodiment, the polyamine may be a hydroxyamine provided that the polyamine contains at least one condensable —N—H group. Typically, the hydroxyamines are primary or secondary alkanol amines or mixtures thereof. Such amines can be represented by mono- and poly-N-hydroxyalkyl substituted alkylene polyamines wherein the alkylene polyamines are as described hereinabove; especially those that contain two to three carbon atoms in the alkylene radicals and the alkylene polyamine contains up to seven amino groups.

In still another embodiment, the amine is selected from the group consisting of a polyamine product having at least one N—H group made by contacting at least one hydroxy-containing material having the general formula $$(R)_nY_z—X_p—(A(OH)_q)_m$$

wherein each R is independently H or hydrocarbon based group, Y is selected from the group consisting of O, N, and S, X is a polyvalent hydrocarbon based group, A is a polyvalent hydrocarbon based group, preferably an alkylene group, n is 1 or 2, z is 0 or 1, p is 0 or 1, q ranges from 1 to about 10, and m is a number ranging from 1 to about 10; with at least one amine having at least one N—H group, and an acylated derivative of the polyamine product containing at least one condensable N—H group polyamine products are described in, for example, Steckel, U.S. Pat. No. 5,160,648.

In one embodiment, the polyamine is the reaction product of any of the aforementioned polyamines with a carboxylic acid or anhydride wherein the resulting product contains at least one condensable N—H group. Such a material may be obtained by employing an excess of amine reactant relative to the carboxylic reactant.

Suitable polyamines of this type include, but are not limited to the reaction product of mono- and poly- carboxylic acids and functional derivatives thereof, such as anhydrides, with at least one polyamine, preferably an alkylene polyamine as defined hereinabove, containing at least two condensable —N—H groups provided that the resulting product contains at least one condensable N—H group. Exemplary of the patent literature relating to such materials are U.S. Pat. Nos. 3,172,892; 3,219,666; 4,234,435 each of which is expressly incorporated herein by reference, and numerous others.

Reaction products useful as the polyamine reactant include, but are not limited by, those prepared by the processes described in the following examples:

Example (b-3)-1

A reaction flask is charged with 698 parts of mineral oil and 108 parts of a commercial polyethylene polyamine mixture having typical %N=34. The materials are stirred and heated to 135° C. at which time 1000 parts of a polybutene substituted succinic anhydride prepared according to the procedure of Example (b-1)-1 are added over 1 hour. With $N_2$ sparging, the temperature is increased to 160° C. and held there for 4 hours while removing water and other volatile components. The product is filtered using a diatomaceous earth filter aid yielding a filtrate typically containing 2% N and a total base number of 45.

Example (b-3)-2

The procedure of example (b-3)-1 is repeated except that before filtration, the materials are reacted with 28 parts of terephthalic acid at 160° for three hours. The product has typical analyses of 1.9% N and a total base number=35.

Example (b-3)-3

The procedure of Example (b-3)-1 is repeated except that before filtration the materials are reacted with 21 parts $CS_2$ to give a sulfur and nitrogen containing condensate.

Example (b-3)-4

A polybutene having a number average molecular weight=1350 (1000 parts) is reacted with 106 parts maleic anhydride with $Cl_2$ blowing (total $Cl_2$ about 90 parts). To a reactor containing 1000 parts of the substituted succinic anhydride is added 1050 parts mineral oil, the materials are heated, with mixing, to 120° C., followed by addition of 70 parts of the commercial amine mixture described in Example (b-3)-1. The reaction mixture is heated to 155° C. over 4 hours with $N_2$ sparging to remove volatiles then filtered employing a diatomaceous earth filter aid. The filtrate typically contains, by analysis, 1.1% N and has a total base number=20.

Example (b-3)-5

An acylated polyamine is prepared by reacting 1000 parts of polyisobutenyl ($\overline{M}_n$ 1000) substituted succinic anhydride with 85 parts of a commercial ethylene polyamine mixture having an average nitrogen content of about 34.5% in 820 parts mineral oil diluent under conditions described in LeSuer U.S. Pat. No. 3,172,892.

Example (b-3)-6

A boron containing composition is prepared by reacting a mixture of 275 parts mineral oil, 147 parts of a commercial ethyleneamine mixture having an average composition corresponding to that of tetraethylenepentamine and 1000 parts of polyisobutene ($\overline{M}_n \approx 1000$) substituted succinic anhydride at 120°–125° C. for 2 hours and at 150° C. for 2 hours then blown with nitrogen at 150° C. for 5 hours to form an acylated amine. To a slurry of 239 parts boric acid in 398 parts mineral oil there is added 1405 parts of above acylated amine over a period of 2 hours. The mixture is heated to 150° C. for 7 hours and filtered employing a diatomaceous earth filter aid to give a liquid product typically containing, by analysis, 1.9% B and 2.3% N.

Example (b-3)-7

A solution of 698 parts mineral oil and 108 parts commercial ethylene polyamine mixture containing an average of about 34% nitrogen is prepared and heated to 115° C. To the oil solution is added 1000 parts of the polybutenyl-substituted succinic anhydride of Example (b-1)-3 under $N_2$ followed by heating to 150° C. The reaction is continued at 143°–150° C. for 1 hour. The product is then filtered.

Example (b-3)-8

The procedure of Example (b-3)-4 is repeated except the polybutenyl group on the substituted succinic anhydride is derived from a polyisobutene having a number average molecular weight, measured by vapor phase osmometry, of about 1700.

Example (b-3)-9

To a mixture of 300 parts of the anhydride of Example (b-1)-2 in 160 parts mineral oil are added, at 65°–95° C., 25 parts of the ethylene polyamine mixture of Example (b-3)-6 followed by heating to 150° C. with $N_2$ blowing to dry the material, then diluted with 79 parts mineral oil.

Example (b-3)-10

A non-acidic nitrogen intermediate is prepared by reacting 2178 parts of the polybutenyl succinic anhydride of example (b-1)-2 and 292 parts of triethylene tetramine in 1555 parts mineral oil at 215° C. for 12 hours, removing aqueous distillate.

The following examples illustrate process for preparing nitrogen and metal containing derivatives (b) used in the preparation of dispersant-viscosity improvers of this invention. Unless indicated otherwise, all parts are parts by weight, temperatures are in degrees Celsius and pressures are atmospheric.

Example b-1

To a mixture of 3264 parts of the anhydride of Example (b-1)-2, 2420 parts mineral oil and 75 parts water are added, in three portions over 0.5 hours at 80°–100° C., 122.1 parts zinc oxide. The materials are reacted for 3 hours at 90°–100° C. then the temperature is increased to 150° C. and maintained at this temperature until it is essentially dry. The materials are cooled to 100° C. then there is added, portionwise over 0.5 hours, 245 parts of an ethylene polyamine mixture having an average composition corresponding to tetraethylene pentamine and an average equivalent weight of 40.8. The materials are heated to 150° C. and are maintained at 150° C.–160° C. for 5 hours while $N_2$ blowing to remove water. The materials are filtered. The filtrate contains 1.63% Zn and 0.72% N.

Example b-2

To a mixture of 80 parts water, 36.5 parts zinc oxide and 650 parts mineral oil are added, as fast as possible without allowing the exothermic reaction to exceed 93° C., 1000 parts of the anhydride of Example (b-1)-5. The materials are reacted for 1.5 hours at 87° C.–93° C., then heated to 121° C. To this material are added 36 parts of an ethylene polyamine mixture containing about 34% N followed by heating to 148° C. the $N_2$ blowing at 148°–155° C. to 0.3% maximum water content and filtration. Mineral oil is added to adjust % Zn to 1.55.

Example b-3

A mixture of 357 parts cobaltous chloride hexahydrate, 2800 parts of the product of Example (b-3)-9 and 250 parts xylene are heated under reflux while removing by azeotropic distillation.

Example b-4

The procedure of Example b-2 is repeated employing 1000 parts of a 80% in mineral oil solution of the anhydride of Example (b-1)-5, 64 parts water, 29.2 parts zinc oxide and 28.8 parts of ethylene polyamine mixture which after filtration is diluted with 132 parts additional mineral oil.

Example b-5

An acylated nitrogen-containing compound is prepared by reacting 2076 parts of the anhydride of example (b-1)-1 and 292 parts triethylene tetramine in 1555 parts mineral oil at 215° C. while removing water followed by filtration. A mixture of 485 parts of this acylated material is reacted with 74 parts zinc dihydrogen phosphate dihydrate in 51 parts mineral oil at 160° C. for 14.5 hours, mixed with 250 parts by volume xylene, then filtered. The filtrate is stripped to 130° C. at 15 mm Hg, then filtered again.

Example b-6

The procedure of Example b-2 is repeated replacing zinc oxide with a stoichiometric equivalent amount of barium oxide.

Example b-7

The procedure of Example b-2 is repeated employing a stoichiometric equivalent amount of potassium carbonate.

Example b-8

The procedure of Example 2 is repeated replacing the succinic anhydride of Example (b-1)-5 with a stoichiometric equivalent amount of the anhydride of Example (b-1)-6

Example b-9

To 440 parts of the product of Example (b-3)-10 ar added at 140°–150° C., over 6 hours, 324 parts of cupric benzoate. The mixture is heated at 140°–150° C. for 3 hours, filtered, then stripped to 65° C. at 35 mm Hg and again filtered.

Example b-10

The procedure of Example b-2 is repeated replacing zinc oxide with a stoichiometric amount of zinc borate.

(c) The Hydroxyl Group-Containing Polyester

The use of the hydroxyl group-containing polyester (c) in preparing the compositions of this invention is unique. The hydroxyl group-containing polyesters are carboxylic compounds which contain at least one condensable hydroxyl group. As defined herein, condensable refers to the group's availability for further reaction with for example, an acylating agent. The polyester (c) may be prepared by reacting a hydrocarbyl-substituted polycarboxylic acid or functional derivative thereof, such as an anhydride, with a polyol, or a mixture of polyols wherein the polyol is present in amounts such that the number of hydroxyl groups thereon exceeds the number required to react with all of the available carboxyl groups. Subsequent condensation is usually carried out at high temperatures with removal of volatiles. Thus, the resulting product is a polyester containing unreacted hydroxyl groups. The unreacted hydroxyl groups are available to be condensed with polymeric acylating reactant (a).

Suitable polycarboxylic acids are the same as those described as reactant (b-1) above.

The polyhydric alcohols useful in the preparation of the polyesters may contain up to about 8 hydroxyl groups, and may be linear or branched. The expressions "branched" or "linear" refer to the configuration of the hydrocarbon backbone of the polyhydric alcohol. The polyhydric alcohol will generally contain from two to about 28 carbons. For example, glycerol, containing 3 hydroxy groups is linear and pentaerythritol, with four hydroxyl groups, is branched. Neopentylene glycol, with 2 hydroxyl groups, is branched.

Specific examples of polyhydroxy compounds useful in the present invention include ethylene glycol, diethylene glycol, triethylene glycol, propylene glycol, dipropylene glycol, glycerol, 1,2- and 1-3-, propanediol neopentylene glycol, 1,2-, 1-3-, and 1,4-butanediols, 1,4-butenediols, pentaerythritol, dipentaerythritol, tripentaerythritol, triglycerol, trimethylolpropane, sorbitol, hexaglycerol, 2,2,4-trimethyl-1,3-pentanediol, etc. Mixtures of any of the above polyhydroxy compounds can be utilized. Preferred polyhydric alcohols are ethylene glycol, neopentylene glycol, glycerol and pentaerythritol. Diols usually result in essentially linear polyesters, whereas triols and higher polyhydric alcohols may result in the formation of branched polyesters. Also, tri- and higher polyhydric alcohols can provide polyesters containing hydroxyl groups. Pentaerythritol is an especially preferred polyhydric alcohol for preparing the polyesters used in this invention.

The polyhydric alcohols used in the preparation of the polyesters also may include polyethers or partial fatty acid esters of polyols or polyether polyols. Useful polyethers include polyoxyalkene diols, such as diethylene glycol and higher oligo(ethylene oxides), alkoxylated glycerol, ethoxylated trimethylol-propane, etc. Partial fatty acid esters useful as polyhydric alcohols will contain at least two free hydroxyl groups. Glycerol monooleate is illustrative of a polyol partial ester.

The polyhydroxy compounds used in the preparation of the hydroxy containing polycarboxylic polyesters also may contain one or more nitrogen atoms. For example, the polyhydroxy compound may be an alkanol amine containing from 2 to 6 hydroxy groups. In one preferred embodiment, the polyhydroxy compound is a tertiary alkanol amine containing at least two hydroxy groups and more preferably at least three hydroxy groups. Illustrative of such aminopolyols are diethanolamine, triethanolamine, and alkoxylated $C_4$–$C_{18}$ primary alkyl amines marketed by Pennwalt and Akzo Chemie, the latter under the tradenames Propomeen and Ethomeen.

The carboxylic esters are prepared by reacting at least one carboxylic acid with at least one polyhydroxy compound containing at least two hydroxy groups. The formation of esters by the interaction of carboxylic acids and alcohols is usually acid catalyzed and is a reversible process which can be made to proceed to completion by use of a large amount of alcohol or by removal of water as it is formed in the reaction. However, esterification can be accomplished by non-catalyzed processes, driven to completion by exhaustive dehydration. If the ester is formed by transesterification of a lower molecular weight carboxylic ester, the reaction can be forced to completion by removal of the low molecular weight alcohol formed as a result of a transesterification reaction. The esterification reaction can be catalyzed by either organic acids or inorganic acids. Examples of inorganic acids include sulfuric acids and acidified clays. A variety of organic acids can be utilized including para-toluenesulfonic acid, acidic resins such as Amberlyst® 15, etc. Organometallic catalysts include, for example, tetraisopropyl orthotitanate and dibutyltin diacetate.

The amounts of carboxylic acids and polyhydroxy compounds included in the reaction mixture may be varied depending on the results desired. However, sufficient polyhydroxy compound must be present to provide a polyester containing at least one free hydroxyl group per average polyester molecule. When mixtures of acids are reacted with a polyhydroxy compound in accordance with the present invention, the carboxylic acids can be reacted sequentially with the polyhydroxy compounds or a mixture of carboxylic acids can be prepared and the mixture reacted with the polyhydroxy compounds.

Throughout the specification and claims, it should be understood that the polyesters also can be formed by reaction of the polyhydroxy compound with the anhydrides of any of the above-described polycarboxylic acids.

However, it is to be further understood that the acid reactants must be capable of generating a polyester. Accordingly, the acidic reactants will always contain at least 80% of the carboxylic functionality as polyacids capable of forming polyesters. Thus, for example, while monocarboxylic acids may be present in the carboxylic acids used to prepare the polyesters they may be only a minor component of the mixture of acidic reactants, at least 80% being polycarboxylic acids capable of forming polyesters with the polyol reactants.

The formation of polyesters by the reaction of carboxylic acids or anhydrides with the polyhydroxy compounds described above can be effected by heating the acids or anhydrides, the polyhydroxy compounds, and a catalyst if used, to an elevated temperature while removing water or low molecular weight alcohols formed in the reaction. Generally, temperatures of from about 175° C. to about 200° C. or higher are sufficient for the reaction.

The following examples illustrate processes for preparing polyesters.

Example c-1

A substantially hydrocarbon-substituted succinic anhydride is prepared by chlorinating a polybutene having a number average molecular weight of 1000 to a chlorine content of 4.5% and then heating the chlorinated polybutene with 1.2 molar proportions of maleic anhydride at a temperature of 150°–220° C. A mixture of 874 grams (2 carbonyl equivalents) of this succinic anhydride and 104 grams (1 mole) of neopentylene glycol is maintained at 240°–250° C./30 mm for 12 hours. The residue is a mixture of hydroxy containing polyester resulting from the esterification of one and both hydroxy groups of the glycol. Typical analyses are acid number of 10, a number average molecular weight of 5500 and an average of one free condensable —OH per polyester molecular weight.

Example c-2

A mixture of 3225 parts (5.0 carbonyl equivalents) of the polybutene-substituted succinic acylating agent prepared in Example (b-1)-1 and 289 parts (8.5 equivalents based on —OH) of pentaerythritol is heated at 224°–235° C. for 5.5 hours, with removal of volatiles by nitrogen blowing. Then 5204 parts mineral oil are added followed by mixing. The homogeneous mixture is filtered at 130° C. to yield an oil solution of the desired polyester product.

Example c-3

A mixture of 1000 parts of polybutene having a number average molecular weight of about 1000 and 108 parts (1.1 moles) of maleic anhydride is heated to about 190° C. and 100 parts (1.43 moles) of chlorine are added beneath the surface over a period of about 4 hours while maintaining the temperature at about 185°–190° C. The mixture is then blown with nitrogen at this temperature for several hours, and the residue is the desired polybutenyl-substituted succinic acylating agent.

A solution of 1000 parts of the above-prepared acylating agent is heated to about 150° C. with stirring, and 109 parts (3.2 equivalents) of pentaerythritol are added with stirring. The mixture is blown with nitrogen and heated to about 220° C. over a period of about 14 hours. The batch is then mixed with 872 parts of mineral oil and filtered using a diatomaceous earth filter aid. The filtrate is an oil solution of the desired carboxylic polyester typically having a number average molecular weight of about 5179.

Example c-4

A reactor is charged with 1000 parts of a polybutenyl-substituted succinic acylating agent prepared as in Example (b-1)-3. At between 160°–175° C. are added 121 parts of pentaerythritol. The materials are heated to 200° C. over 8 hours followed by nitrogen blowing at 204°–210° C. for 8 hours. Water is removed and is collected. Upon completion of the reaction, the materials are diluted with 872 parts of mineral oil and the solution is filtered with a diatomaceous earth filter aid. Typical analyses are acid number=8. The polyester contains about 1.8 —OH groups per repeating unit.

Example c-5

Following essentially the procedure of Example (b-1)-1, a tetrapropenyl-substituted acylating agent is prepared and converted to a pentaerythritol polyester.

Example c-6

A reactor charged with 1000 parts of the $C_{18-24}$ substituted succinic anhydride of Example (b-1)-7 and 289 parts of pentaerythritol is heated to 200° C. and is held at 200° C. to 235° C. for 5 hours, removing volatiles by $N_2$ blowing. The materials are diluted with 800 parts of mineral oil and filtered.

Example c-7

A reactor is charged with 1000 parts of the product of Example (b-1)-6 and 464 parts of mineral oil. The materials are heated to 140° C. under $N_2$, 110 parts pentaerythritol are added and the materials are heated to 210° C. over 6 hours while removing water employing a sub-surface $N_2$ sparge. At this point 750 parts oil are added and the batch is cooled to 150° C. and filtered.

The carboxylic polyester derivatives which are described above resulting from the reaction of an acylating agent with a polyhydroxy-containing compound such as polyol or aminopolyol may be further reacted with any of the hereinafter described amines, and particularly polyamines.

These polycarboxylic acid derivative compositions are known in the art, and the preparation of a number of these derivatives is described in, for example, U.S. Pat. Nos. 3,957,854 and 4,234,435 which are hereby expressly incorporated herein by reference. The following examples illustrate the preparation of the esters wherein an alkanolamine or both an alcohol and an amine are reacted with the acylating agent.

Example c-8

A reactor is charged with 1000 parts of a polybutenyl-substituted succinic anhydride prepared essentially as described in Example (b-1)-3, 109 parts pentaerythritol and 31 parts Polyglycol® 112-3, a polyether polyol obtained by reacting glycerol, propylene oxide and ethylene oxide, having a molecular weight ranging from about 4600 to about 5300. The mixture is heated to 210° C. over 6 hours employing a sub-surface $N_2$ sparge. The materials are cooled to 160° C. and a toluene solution of 19 parts of commercial ethylene polyamine having a % N of about 34 is added over 1 hours followed by heating and $N_2$ sparging at 160° C. for 3 hours. The product is diluted with 800 parts mineral oil and filtered using a diatomaceous earth filter aid.

Example c-9

To the polyester of example (c-1)-3 are added 857 parts of mineral oil and 19.25 parts (0.46 equivalent) of a commercial mixture of ethylene polyamines having an average of about 3 to 10 nitrogen atoms per molecule. The reaction mixture is further stripped of volatiles by heating at 205° C. with nitrogen blowing for 3 hours and filtered. The filtrate is an oil solution (45% 100 neutral mineral oil) of the desired amine-modified carboxylic polyester of about 2850 number average molecular weight which contains 0.35% nitrogen, total base number of 2 and total acid number of 4.

Example c-10

A reactor equipped with a stirrer, condenser with Dean-Stark trap, thermocouple probe and $N_2$ inlet ($N_2$ at 0.5 standard cubic feet/hour (SCFH)) is charged with 1100 parts of a polybutenyl substituted succinic anhydride prepared according to the procedure of Example (c-1)-3, 146 parts triethanolamine and 125 parts toluene. The mixture is heated to 210° over 4 hours then stirring and heating is continued at this temperature for 26 hours, collecting a clear yellow distillate having pH 7–9 in the Dean-Stark trap. $N_2$ flow is increased to 1.5 SCFH and stirring is continued at temperature for 3 additional hours, cool to 105°, and charge 800 parts mineral oil. The materials are stirred at temperature for 0.5 hour, mixed with a diatomaceous earth filter aid and filtered. The filtrate contains, by analysis, 0.69% N and 0.18% —OH. Total acid no.=1.83; total base no.=22.9.

Example c-11

A reactor is charged with 1000 parts of the polyester of Example (b-1)-7 and heated to 150° C. A solution of 15 parts of a commercial polyamine having about 34% nitrogen and total base number of 41 in 15 parts toluene is added over 0.5 hour. The materials are stirred for 2 hours at 160° C. with $N_2$ sparging, 550 parts mineral oil is added and the solution is filtered.

Other discussions and illustrations of suitable procedures are provided, for example, in LeSuer, U.S. Pat. No. 3,381,022 and U.S. Pat. No. 3,522,179 and Meinhardt et al, U.S. Pat. No. 4,234,435.

As noted above, the use of the polyester in the invention is optional. When the polyester is used, he acylated copolymer (a) and hydroxy-containing polyester (c) are reacted in ratios ranging from about 1 C═O in (a) to about 0.1 OH in the polyester up to about 1 C═O from (a) to about 20 OH from (c), preferably 1 C═O to about 5 OH up to about 1 C═O to about 10 OH. In another embodiment, (a) and (c) are reacted in amounts ranging from about 4–16 OH per C═O, more often from about 8–14 OH per C═O.

The reactions are generally conducted at elevated temperatures, usually at temperatures ranging from about 100° C. to about 300° C. or even higher, but below the decomposition temperature of any of the reactants or products. Typical temperatures are those given in the following examples.

Compositions of this invention may be prepared by reacting the reactants in a variety of ways. For example (c) may be first reacted with (b) before reaction with (a). In another embodiment, (c) is reacted with the product formed by reacting (a) and (b) or may be reacted simultaneously with (a) and (b). In one embodiment, (c) is not used.

The reactant ratios of components (a) and (b) may be expressed either by weight or by equivalents. In one embodiment, component (a) is used in amounts ranging from about 0.05 to 10 parts by weight, more often from about 0.1 to about 6 parts by weight, frequently from about 0.2 to about 5 parts by weight per part by weight of component (b).

In another embodiment, the ratio is expressed in terms of equivalents. One equivalent of (a) is one carboxyl equivalent. The number of equivalents is determined by dividing the average molecular weight of (a) by the number of carboxyl equivalents present per average molecular weight. For example, if (a) has an average molecular weight of 100,000 and there are 4 carboxylic groups present per average molecular weight, then one equivalent is 100,000 divided by 4, or 25,000. The equivalent weight of (b) is calculated by determining the total base number employing ASTM Procedure D-974, Standard Test Method for Acid and Base Number by Color-Indicator Titration, modified by using bromphenol blue indicator in place of methyl orange. Components (a) and (b) are reacted in amounts ranging from about 0.05 to about 5 equivalents (a) per equivalent of (b), preferably from about 0.1 to about 3 equivalents (a) per equivalent of (b), more preferably from about 0.15 to about 2 equivalents (a) per equivalent of (b). The following examples are intended to illustrate several compositions of this invention as well as means for preparing same.

EXAMPLE 1

Part A

A reactor equipped with a stirrer, condenser, $N_2$ inlet, thermometer, addition funnel and Dean-Stark trap is charged with 4320 parts of 100 Neutral (100N) mineral oil and 480 parts of a commercial hydrogenated styrene-isoprene diblock copolymer having a number average molecular weight ($\overline{M}_n$)=155,000 (Shellvis 40, Shell Chemical) and heated to 140° C. under $N_2$ with stirring and held at 140° C. for 4 hours to obtain a homogeneous solution. To the solution are added 14.4 parts maleic anhydride followed by heating to 160° C. Over 1 hour, 14.4 parts tertiary butyl peroxide are added dropwise then held at 160° C. for 1.5 hour, all under $N_2$ blanket. The temperature is increased to 165° C. and is $N_2$ blown at 1 SCFH for 2 hours. To the residue are added 1200 parts diphenyl alkane (Vista Chemical) followed by stifling at 120° for 1 hour. Total acid number of solution is 2.5 determined using $NaOCH_3$/thymol blue indicator.

Part B

To the reactor containing 6000 parts of the product of Part A, above, are added 2000 parts of the product of example b-1 in a steady stream over 0.5 hour. The mixture is stirred and heated to 160° C. over 1 hour and maintained at 160° C. while removing volatile condensation products with a $N_2$ sparge. The mixture is cooled to 120° C. to give a zinc and nitrogen containing product.

EXAMPLE 2

Part A

The procedure of Example 1, Part A is repeated employing 600 parts of polymer, 5400 parts mineral oil, 30 parts each maleic anhydride and tertiary butyl peroxide and 1500 parts diphenyl alkane. Acid number is 4.4.

Part B

Following the procedure of Example 1 Part B, a solution is prepared by mixing 1000 parts of the product of Part A of this example and 450 parts of the product of Example b-2 while maintaining $N_2$ and removing distillate. The materials are stripped to 155° at 15 mm Hg pressure then diluted with 198 parts diphenyl alkane (Vista). The solution is filtered through cloth.

EXAMPLE 3

Part A

A reactor equipped with a stirrer, gas inlet, wide-mouth addition funnel, thermowell and condenser is charged with 5950 parts of hydrotreated 100 neutral paraffinic oil. The oil is heated, under nitrogen sweep at 0.4 standard cubic feet per hour (SCFH) to 160° C. At this temperature, 1050 parts of an ethylene-propylene copolymer (52% ethylene, 48% propylene, by weight) having a weight average molecular weight ($\overline{M}_w$) of 210,000 and an $\overline{M}_w/\overline{M}_n$ ($\overline{M}_n$=number average molecular weight; $\overline{M}_w$=weight average molecular weight) of 1.8 is added as small pieces (about ½–⅜" cubes) over 3 hours. After 4 hours at 160° C. all polymer appears to have dissolved, but the mixture is stirred for 16 hours additional at 160° C.

Part B

The solution is cooled to 130° C., nitrogen flow is reduced to 0.05–0.1 SCFH and 15.3 parts maleic anhydride is charged followed by stirring for 0.25 hours. A solution of 15.3 parts of tertiary butyl peroxybenzoate in 20 parts of toluene is added dropwise over one hour followed by mixing 3 hours at 130°–135° C. The temperature is increased to 160° C. and the reaction mixture is nitrogen stripped at 2 SCFH for 4 hours to remove toluene and residual maleic anhydride. Saponification number=1.7; viscosity (100° C.)= 7258 centistokes.

Part C

An open reactor equipped with a mechanical stirrer, thermometer and below-surface $N_2$ inlet is charged with 600 parts of the product of Part B of this example. The materials are heated to 150° C., under $N_2$, then 180 parts of the product of Example c-3 are added over 0.25 hours followed by heating at 150° C. for 0.5 hours. Then 120 parts of the product of Example b-2 are added in a slow stream over 0.25 hours, the temperature is increased to 160° C. and maintained at 160° C. for 3 hours. The reaction product contains 0.08% N and 0.18% Zn.

EXAMPLE 4

A reactor equipped as in Part C. of Example 3 is charged with 600 parts of the product of Part B of that example which is heated, under $N_2$, to 150° C. followed by addition, over 0.25 hours, of 240 parts of the product of Example b-2. The temperature is increased to 160° C. and is maintained at 160° C. for 3 hours. The reaction product contains 0.27% N and 0.36% Zn.

EXAMPLE 5

A reactor equipped with a stirrer, thermometer, $N_2$ inlet, addition funnel, Dean Stark trap and consumer is charged with 1000 parts of a reaction product prepared as in Part B of Example 3 and 500 parts mineral oil. The materials are mixed under $N_2$, to 130° C. whereupon over 0.1 hour are added 300 parts of the product of Example c-3 while the temperature is increased to 150° C. At this time, 200 parts of the reaction product of Example b-2 are added over 0.2 hours. The temperature is increased to 160° C. and the $N_2$ purge rate is also increased. The reaction is continued for 3 hours at 160° C. at which time the Dean-Stark trap contains less than 1 part of distillate. Theory analyses are 0.15% Zn and 0.07% N.

EXAMPLE 6

Part A

An oil solution is prepared by adding, over 0.5 hours, 1125 parts of Ortholeum 2052, a terpolymer containing about 48 weight percent each of ethylene units and propylene units and 4 weight percent 1,4-hexadiene units (E.I. DuPont deNemours) to a reactor containing 6375 parts paraffinic mineral oil, heating to 157° C. and mixing, under $N_2$, at 157°–160° C. for 6 hours, then added 11.5 parts maleic anhydride, stirring until the maleic anhydride dissolved. To this solution are added 11.5 parts di-t-butyl peroxide, dropwise over 1 hour. The reaction is continued at 157°–160° C. for one hour, then the temperature is increased to 163° C. and held at 163°–166° C., with increased $N_2$ purge for 3 hours to remove volatile materials.

Part B

A reactor is charged with 4347 parts of the product of Part A of this example and 2173.5 parts of the product of Example c-3, is heated, under $N_2$, to 150° C. then held at 150°–153° C. for 1.5 hours. To this material are added 978.1 parts of the product of Example b-2 over 0.3 hours, then temperature is maintained at 150°–153° C. for 3 hours with increased $N_2$ sparge during the last 0.75 hours. The product contains 0.056% N and 0.15% Zn.

EXAMPLE 7

A reactor is charged with 550 parts of the product of Example 6, Part A, 20 parts xylene and 220 parts of the product of Example b-2. The materials are heated for 3.5 hours at 160° C. under $N_2$, removing xylene while heating, with increased $N_2$ flow during last 0.5 hour.

EXAMPLE 8

Part A

A reactor equipped with thermowell, condenser, stirrer and subsurface $N_2$ inlet is charged with 2420 parts mineral oil. Over 0.5 hours are added, with stirring, 427 parts of a copolymer containing, by analysis, ethylene and propylene units in a weight ratio of 57:43, containing 1.4% by weight units derived from dicyclopentadiene and having polydispersity ($\overline{M}_w/\overline{M}_n$=2.2. $N_2$ sparging is at 0.2 SCFH. The materials are heated to 160° C. and held at 160° C. overnight to dissolve the polymer. To this solution are added 4.3 parts maleic anhydride. The materials are stirred to dissolve maleic anhydride and the condenser is washed with about 5 parts toluene. Over 1 hour, at 160° C. are added, dropwise, 4.3 parts t-butyl-peroxide. The reaction is held at 160° C. for 2 hours and the $N_2$ sparging is increased to 1.5 SCFH for 3 additional hours to remove volatiles.

Part B

A reactor equipped with stirrer, thermometer and below surface $N_2$ inlet charged with 300 parts of the product of Part A of this example, 120.4 parts of the polyester of Example c-3 and 20 parts mineral oil. The materials are heated under $N_2$, with mixing, to 150° C. and are held at 150° C. for 1 hour. 66.1 parts of the product of Example b-2 are added, and heating is continued at 150° C. for 3-½ hours ($N_2$ increased to 1.5 SCFH during last 0.5 hour to remove volatiles). The reaction product contains 0.114% Zn, 0.64% N, has total acid number of 245 and total base number 4.5.

EXAMPLE 9

A reactor is charged with 1200 parts of the product of Part A of Example 8, 255 parts of the product of Example b-2 and 30 parts toluene. The materials are heated, under $N_2$, at 155°–160° C. for 3 hours, removing toluene during last 0.5 hour by increased $N_2$ flow.

EXAMPLE 10

Part A

A reactor equipped with a stirrer, $N_2$ inlet, wide-mouth addition funnel, thermowell and condenser is charged with 5950 parts mineral oil. $N_2$ purging is begun and the oil is heated to 160° C. followed by the addition, over 2.5 hours, of 1050 parts of the copolymer of Part A of Example 8. The materials are held at 160° C. for four hours. The solution is cooled to 130° C. Continuing $N_2$ at a reduced rate, 15.3 parts maleic anhydride are added followed by dropwise addition over 1.5 hours of a solution of 15.3 parts t-butyl peroxybenzoate in 20 parts toluene. The materials are heated at 130° C. for 2 hours, then allowed to cool. At this stage the material is very viscous. The materials are heated to 120° C. at which time stirring is begun. Under increased $N_2$ purge, the materials are heated to 160° C. and held at 160° C. for 2 hours.

Part B

A reactor is charged with 600 parts of the product of Part A of this example which is then heated to 160° C. while blowing with $N_2$. Over 0.25 hour are added 180 parts of the product of Example c-3, followed by stirring at temperature for 0.5 hour. To this mixture are added, over 0.25 hour, 120 parts of the product of example b-2 followed by heating at 160° C. for 3 hours.

EXAMPLE 11

A reactor equipped with a stirrer, subsurface $N_2$ inlet and thermowell is charged with 550 parts of the product of Part A of example 10 and 15 parts toluene. The materials are heated to 150° C. while blowing with $N_2$ followed by addition of 220 parts of the product of example b-2. The temperature is increased to 160° C. and is maintained at 160° C. for 3 hours.

EXAMPLE 12

A reactor is charged with 1000 parts of a product prepared as in Example 10, Part B, and 375 parts mineral oil. Under $N_2$, the materials are heated to 130° C., 300 parts of the product of example c-3 are added in a slow stream over 0.25 hour, the materials are heated to 160° C. over 0.5 hour and held at 160° C. for 0.5 hour. To this solution are added, as a slow stream over 0.25 hour, 200 parts of the product of example b-2 followed by heating at 155° C.–160° C. for 3 hours while collecting less than 0.5 part distillate.

EXAMPLE 13

A solution is prepared by mixing for 1 hour at 100° C. 1633.5 parts of the product of example 12 and 233.6 parts mineral oil.

EXAMPLE 14

Part A

A reactor is charged with 5850 parts of mineral oil and 650 parts of hydrogenated styrene-butadiene copolymer having $\overline{M}_n$ about 140,000 as measured by GPC. The materials are stirred for 24 hours at 130° C. under $N_2$ until the mixture is homogeneous. Over 2 hours at 130° C., continuing $N_2$, are simultaneously added 68.1 parts molten maleic anhydride and a solution of 16.4 parts t-butyl perbenzoate (Lucidol Corp.) in 75 parts toluene. Upon completion of the addition, the materials are heated at 130° C. for 5 hours then stripped to 150° C. at 15 mm Hg pressure.

Part B

To a reactor are charged 150 parts of the product of Part A of this example, 75 parts of the product of example b-2, 37.5 parts mineral oil, and 30 parts xylene. The materials are heated to 150° C. over 2 hours with $N_2$ blowing and held at 150° C. for 3 hours with $N_2$ increased to blow out residual solvent.

EXAMPLE 15

Part A

The procedure of Example 14, Part A is repeated except a solution of 6.6 parts t-butyl perbenzoate in 10 parts toluene is used.

Part B

The procedure of Example 14, part B is repeated except the product of Part A of this example is employed.

EXAMPLE 16

Part A

The hydrogenated styrene-butadiene copolymer of Part A of Example 14 is reacted with 2% by weight based on polymer weight of maleic anhydride employing t-butyl peroxide (0.25% weight) at 220° C. in a twin screw extruder.

Part B

A solution of 240 parts of the product of part A of this example is mixed with 2760 parts mineral oil for 16 hours at 130° C.

Part C

A reactor is charged with 135 parts of the product of part A of this example, 67.5 parts mineral oil diluent and 25 parts xylene, heated to 100° C. under $N_2$ whereupon 5.4 parts of the product of example c-3 are added. The temperature is increased to 150° C. and is held for 1 hour then cooled to 100° C. To this mixture are added 8.26 parts of the product of example b-2, the temperature is increased to 150° C. and held there for 2 hours.

Part D

Following substantially the procedure of Example 16C, a product is obtained by reacting 180.8 parts of a product prepared as in Example 16B, 90.4 parts of the product of Example C-3, and 37.54 parts of the product of Example b-2 in 47 parts xylene.

EXAMPLE 17

A reactor is charged with 128 parts of the product of part A of Example 14, 64 parts of the product of Example c-3, 40.4 parts of the product of Example b-2 and 30 parts xylene. The materials are heated to 95° C. with $N_2$ and held there for 2 hours. The temperature is increased to 150° C. over 1.5 hour and held at temperature for 3 hours while $N_2$ blowing at increased rate to remove solvent.

EXAMPLE 18

The procedure of Example 17 is repeated using the product of Part A of Example 15.

EXAMPLE 19

Part A

A reactor is charged with 2700 parts of mineral oil which is then heated to 135° C. under $N_2$. To this are added 300 parts of the styrene-butadiene polymer of Example 14 followed by heating at 135° C. for 8 hours. Xylene (200 parts) are added, the temperature is increased to 145° C., 15 parts maleic anhydride are added, then a solution of 15 parts t-butylperbenzoate in 10 parts xylene are added subsurface, dropwise, over 1 hour. After addition is completed, the materials are maintained at 145° C. for 1 hour, the temperature is increased to 165° C. and the materials are blown with $N_2$ at an increased rate to remove solvent.

Part B

A reactor is charged with 130 parts of the product of part A of this example, 20.78 parts mineral oil and 20 parts xylene which are mixed under $N_2$, To this are added 65 parts of the product of example c-3, the temperature is increased to 150° C. and held for 2 hours, the materials are cooled to 110° C. whereupon 44.22 parts of the product of example b-2 are added. The materials are heated to 150° C. and held for 2.5 hours.

EXAMPLE 20

Part A

The procedure of Example 14, part A is repeated employing 300 parts of the styrene-butadiene copolymer, 2700 parts mineral oil, 21 parts maleic anhydride, 7.5 parts t-butylperbenzoate and 35 parts toluene.

Part B

A mixture of 252 parts of the product of part A of this example in 25 parts toluene is heated to 95° C. with $N_2$ sparging, 1.32 parts 2-butoxyethanol are added and the temperature is increased to 150° C. After 3 hours at 150° C., 15.45 parts of the product of Example b-2 are added and the materials are heated for another 3 hours. During the last 0.75 hour of heating, $N_2$ blowing rate is increased to remove residual xylene.

EXAMPLE 21

Part A

A mixture of 21 parts maleic anhydride and 15.9 parts n-butanol is heated at 100°–110° C. for 3.5 hours to form the half-ester. In another reactor, a mixture of 300 parts of the styrene-butadiene copolymer of Example 14 are mixed, under $N_2$, at 130° C. for 24 hours. A mixture of 7.5 parts t-butylperbenzoate in 35 parts toluene, and a second mixture of the maleate half-ester in 15 parts toluene are added simultaneously over 2 hours, followed by heating at temperature for 5 hours then stripped to 150° C. at 17 mm Hg pressure.

Part B

A mixture of 220 parts of the product of Part A of this example, 20.34 parts of the product of example b-2 and 22 parts toluene are mixed with $N_2$ blowing, followed by heating to 95° C. with foaming. When foaming subsides, the temperature is increased to 150° C. and is maintained for 3.5 hours, $N_2$ at increased rate during last 0.5 hour to remove residual xylene.

EXAMPLE 22

Part A

A mixture of the styrene-butadiene copolymer of Example 14 and 2700 parts mineral oil is heated for 20 hours at 135° C. to obtain a homogeneous mixture. While maintaining temperature, a solution of 7.6 parts t-butylperbenzoate in 35 parts toluene and another solution of 25 parts itaconic acid in 52 parts 2-methoxyethyl ether are added simultaneously over 2 hours. The mixture is held at temperature for 5 hours then is stripped to 160° C. at 20 mm Hg.

Part B

A mixture of 160 parts of the product of Part A of this example, 80 parts of the product of Example b-2 and 25 parts xylene is heated under $N_2$ for 4 hours followed by heating with $N_2$ at an increased rate for 1 hour.

EXAMPLE 23

Part A

A reactor equipped with a stirrer, thermometer, water-cooled condenser and gas inlet is charged with 6912 parts of mineral oil (100 Neutral, Sun Oil). A nitrogen purge is begun and is maintained throughout the process. Hydrogenated styrene-isoprene copolymer having a molecular weight measured by gel permeation chromatography of about 180,000 (Shellvis 40, Shell Chemical Company), 768 parts, is added over 0.5 hours. The temperature is increased to 157° C. and is maintained at 157°–160° C. for 3 hours, until the polymer is completely dissolved. To this oil solution are added 19.2 parts of maleic anhydride, the materials are stirred for 0.25 hour then 19.2 parts ditertiary butyl peroxide are added over 1 hour. The materials are held at 159° C. for 1 hour, then the temperature is increased to 163° C. and the $N_2$ flow is increased. The reaction is held at 163°–166° C. for 3 hours, collecting a small amount of distillate. $N_2$ flow is decreased and 1920 parts diphenylalkane are added. The temperature is maintained at 150° C. for 0.5 hour.

Part B

A reactor containing 210 parts of the product of Part A of this example is heated to 110° C. under $N_2$. To the heated solution are added 70 parts of the product of Example b-2, the materials are heated to 160° C. and then held there for 2 hours.

EXAMPLE 24

The procedure of Part B of example 23 is repeated replacing the product of Example b-2 with 75 parts of the product of Example b-9.

The Oil of Lubricating Viscosity

The lubricating compositions and methods of this invention employ an oil of lubricating viscosity, including natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity. Hydrotreated naphthenic oils are well known. Oils of lubricating viscosity derived from coal or shale are also useful.

Synthetic lubricating oils include hydrocarbon oils and halosubstituted hydrocarbon oils such as polymerized and interpolymerized olefins, etc. and mixtures thereof, alkylbenzenes, diphenyl alkanes, polyphenyl, (e.g., biphenyls, terphenyls, alkylated polyphenyls, etc.), alkylated diphenyl ethers and alkylated diphenyl sulfides and their derivatives, analogs and homologues thereof and the like.

Alkylene oxide polymers and interpolymers and derivatives thereof, and those where terminal hydroxyl groups have been modified by esterification, etherification, etc., constitute other classes of known synthetic lubricating oils that can be used.

Another suitable class of synthetic lubricating oils that can be used comprises the esters of dicarboxylic acids and those made from $C_5$ to $C_{12}$ monocarboxylic acids and polyols or polyether polyols.

Other synthetic lubricating oils include liquid esters of phosphorus-containing acids, polymeric tetrahydrofurans, alkylated diphenyloxides and the like.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

Specific examples of the above-described oils of lubricating viscosity are given in Chamberlin III, U.S. Pat. No. 4,326,972 and European Patent Publication 107,282, both of which are hereby incorporated by reference for relevant disclosures contained therein.

A basic, brief description of lubricant base oils appears in an article by D. V. Brock, "Lubrication Engineering", Volume 43, pages 184–5, March, 1987, which article is expressly incorporated by reference for relevant disclosures contained therein.

Other Additives

As mentioned, the compositions of this invention may contain minor amounts of other components. The use of such additives is optional and the presence thereof in the compositions of this invention will depend on the particular use and level of performance required. The compositions may comprise a zinc salt of a dithiophosphoric acid. Zinc salts of dithiophosphoric acids are often referred to as zinc dithiophosphates, zinc O,O-dihydrocarbyl dithiophosphates, and other commonly used names. They are sometimes referred to by the abbreviation ZDP. One or more zinc salts of dithiophosphoric acids may be present in a minor amount to provide additional extreme pressure, anti-wear and antioxidancy performance.

In addition to zinc salts of dithiophosphoric acids discussed hereinabove, other additives that may optionally be used in the lubricating oils of this invention include, for example, detergents, dispersants, viscosity improvers, oxidation inhibiting agents, metal passivating agents, pour point depressing agents, extreme pressure agents, anti-wear agents, color stabilizers and anti-foam agents. The above-mentioned dispersants and viscosity improvers are used in addition to the additives of this invention.

Auxiliary extreme pressure agents and corrosion and oxidation inhibiting agents which may be included in the compositions of the invention are exemplified by chlorinated aliphatic hydrocarbons, organic sulfides and polysulfides, phosphorus esters including dihydrocarbyl and trihydrocarbyl phosphites, molybdenum compounds, and the like.

Auxiliary viscosity improvers (also sometimes referred to as viscosity index improvers) may be included in the compositions of this invention. Viscosity improvers are usually polymers, including polyisobutenes, polymethacrylic acid esters, diene polymers, polyalkyl styrenes, alkenylarene-conjugated diene copolymers and polyolefins. Multifunctional viscosity improvers, other than those of the present invention, which also have dispersant and/or antioxidancy properties are known and may optionally be used in addition to the products of this invention. Such products are described in numerous publications including those mentioned in the Background of the Invention. Each of these publications is hereby expressly incorporated by reference.

Pour point depressants are a particularly useful type of additive often included in the lubricating oils described herein. See for example, page 8 of "Lubricant Additives" by C. V. Smalheer and R. Kennedy Smith (Lezius-Hiles Company Publisher, Cleveland, Ohio, 1967). Pour point depressants useful for the purpose of this invention, techniques for their preparation and their use are described in U.S. Pat. Nos. 2,387,501; 2,015,748; 2,655,479; 1,815,022; 2,191,498; 2,666,748; 2,721,877; 2,721,878; and 3,250,715 which are expressly incorporated by reference for their relevant disclosures.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125–162.

Detergents and dispersants may be of the ash-producing or ashless type. The ash-producing detergents are exemplified by oil soluble neutral and basic salts of alkali or alkaline earth metals with sulfonic acids, carboxylic acids, phenols or organic phosphorus acids characterized by at least one direct carbon-to-phosphorus linkage.

The term "basic salt" is used to designate metal salts wherein the metal is present in stoichiometrically larger amounts than the organic acid radical. Basic salts and techniques for preparing and using them are well known to those skilled in the art and need not be discussed in detail here.

Ashless detergents and dispersants are so-called despite the fact that, depending on its constitution, the detergent or dispersant may upon combustion yield a nonvolatile residue such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Patent number 1,306,529 and in many U.S. patents including the following:

| | | |
|---|---|---|
| 3,163,603 | 3,381,022 | 3,542,680 |
| 3,184,474 | 3,399,141 | 3,567,637 |
| 3,215,707 | 3,415,750 | 3,574,101 |
| 3,219,666 | 3,433,744 | 3,576,743 |
| 3,271,310 | 3,444,170 | 3,630,904 |
| 3,272,746 | 3,448,048 | 3,632,510 |
| 3,281,357 | 3,448,049 | 3,632,511 |
| 3,306,908 | 3,451,933 | 3,697,428 |
| 3,311,558 | 3,454,607 | 3,725,441 |
| 3,316,177 | 3,467,668 | 4,194,886 |
| 3,340,281 | 3,501,405 | 4,234,435 |
| 3,341,542 | 3,522,179 | 4,491,527 |
| 3,346,493 | 3,541,012 | RE 26,433 |
| 3,351,552 | 3,541,678 | |

(2) Reaction products of relatively high molecular weight aliphatic or alicyclic halides with amines, preferably polyalkylene polyamines. These may be characterized as "amine dispersants" and examples thereof are described for example, in the following U.S. patents:

| | |
|---|---|
| 3,275,554 | 3,454,555 |
| 3,438,757 | 3,565,804 |

(3) Reaction products of alkyl phenols in which the alkyl groups contains at least about 30 carbon atoms with aldehydes (especially formaldehyde) and amines (especially polyalkylene polyamines), which may be characterized as "Mannich dispersants". The materials described in the following U.S. patents are illustrative:

| | |
|---|---|
| 3,413,347 | 3,725,480 |
| 3,697,574 | 3,726,882 |
| 3,725,277 | |

(4) Products obtained by post-treating the carboxylic amine or Mannich dispersants with such reagents are urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |
| | | | 4,234,435 |

(5) Interpolymers of oil-solubilizing monomers such as decyl methacrylate, vinyl decyl ether and high molecular weight olefins with monomers containing polar substituents, e.g., aminoalkyl acrylates or methacrylates, acrylamides and poly-(oxyethylene)-substituted acrylates. These may be characterized as "polymeric dispersants" and examples thereof are disclosed in the following U.S. patents

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

The above-illustrated additives may each be present in lubricating compositions at a concentration of as little as 0.001% by weight usually ranging from about 0.01% to about 20% by weight, more often from about 1% to about 12% by weight. In most instances, they each contribute from about 0.1% to about 10% by weight.

The compositions of the present invention are present in minor amounts, often amounts ranging from about 1% to about 29% by weight, more often from about 3% to about 10% by weight, even more often from about 5% to about 8% by weight.

The various additives described herein can be added directly to the lubricant. Preferably, however, they are diluted with a substantially inert, normally liquid organic diluent such as mineral oil, naphtha, benzene, toluene or xylene, to form an additive concentrate. These concentrates usually comprise about 0.1 to about 80% by weight of the compositions of this invention and may contain, in addition, one or more other additives known in the art or described hereinabove. Concentrations such as 15%, 20%, 30% or 50% or higher may be employed.

The lubricating compositions of this invention are illustrated by the examples in the following Tables. The lubricating compositions are prepared by combining the specified ingredients, individually or from concentrates, in the indicated amounts and oil of lubricating viscosity to make the total 100 parts by weight. The amounts shown are indicated as parts by weight or parts by volume. Unless indicated otherwise, where components are indicated as parts by weight, they are amounts of chemical present on an oil-free basis. Thus, for example, an additive comprising 50% oil used at 10% by weight in a blend, provides 5% by weight of chemical. Where oil or other diluent content is given, it is for information purposes only and does not indicate that the amount shown in the table includes oil. Amounts of products of examples of this invention include oil content, if any.

Where percentages of components are on a volume basis, the examples indicate the amounts of diluent (if any) present in the component as percent by weight diluent.

These examples are presented for illustrative purposes only, and are not intended to limit the scope of this invention. The expression MR refers to metal ratio, the number of equivalents of metal present compared to the number of equivalents that is present for the stoichiometrically neutral product.

Examples I–VI

Lubricating oil compositions are prepared by blending in a mineral oil basestock (Exxon 15W-40), 1% calcium overbased (MR~1.1) sulfurized phenate, 0.6% calcium overbased (MR~2.3) sulfurized phenate, 0.5% calcium overbased (MR~1.2) alkyl benzene sulfonate, 0.4% magnesium overbased (MR~14.7) alkyl benzene sulfonate, 0.25% di-(nonylphenyl) amine, 1.14% zinc mixed primary-secondary dialkyl dithiophosphate, 1.16% reaction product of polyisobutenyl ($\overline{M}_n$~960) substituted succinic anhydride with pentaerythritol and ethylene polyamine, 70 ppm silicone antifoam agent and the indicated amounts of the components listed in the following table:

| Component | Example (% by weight-oil free basis) | | | | | |
|---|---|---|---|---|---|---|
| | I | II | III | IV | V | VI |
| Reaction product of polyisobutyl ($\overline{M}_n$~1500) substituted succinic anhydride with ethylene polyamine | 2.2 | 2.2 | 2.2 | 1.76 | 1.3 | 0.86 |
| Product of Example 3-C | 4.7 | | | 5.7 | 5.7 | 5.7 |
| Product of Example 4 | | 4.5 | | | | |
| Product of Example 5 | | | 7.7 | | | |
| Styrene maleate copolymer neutralized with aminopropyl morpholine | 0.08 | 0.08 | | | | |
| VISCOPLEX 1-31 (polyalkyl-methacrylate) | | | 0.3 | 0.3 | 0.3 | 0.3 |

Example VII

A lubricating oil composition as in Example I employing 5.7% by weight of the product of Example 3-C.

Example VIII

A lubricating oil composition as in Example I employing 10.5% by weight of the product of Example 3-C.

Example IX

A lubricating oil composition as in Example II employing 5.5% by weight of the product of Example 4.

Example X

A lubricating oil composition as in Example II employing 7.1% by weight of the product of Example 4.

Example XI

A lubricating oil composition as in Example III employing 8.3% by weight of the product of Example 5.

Example XII

A lubricating oil composition as in Example III employing 8.5% by weight of the product of Example 5.

Example XIII

A lubricating oil composition as in Example IV employing 5.8% by weight of the product of Example 3-C.

Example XIV

A lubricating oil composition as in Example IV employing 5.5% by weight of the product of Example 4 in place of the product of Example 3-C.

Example XV

A lubricating oil composition as in Example XIV employing 6% by weight of the product of Example 4.

Example XVI

A lubricating oil composition as in Example V employing 6.4% by weight of the product of Example 3-C.

Example XVII

A lubricating oil composition as in Example VI employing 7% by weight of the product of Example 3-C.

Example XVIII

A lubricating oil composition as in Example V replacing the product of Example 3-C with 5.5% by weight of the product of Example 4.

Example XIX

A lubricating oil composition as in Example XVIII employing 5.5% by weight of the product of Example 4.

Example XX

A lubricating oil composition as in Example XVIII employing 6.5% by weight of the product of Example 4.

Example XXI

A lubricating oil composition as in Example VI replacing the product of Example 3-C with 5.5% by weight of the product of Example 4.

Example XXII

A lubricating oil composition as in Example XXI employing 7.1% by weight of the product of Example 4.

Examples XXIII–XXV

Lubricating oil compositions are prepared by blending in a mineral oil basestock (Exxon 15W-40), 0.08% styrene-maleate copolymer, neutralized with aminopropylmorpholine, 1.63% of reaction product of polyisobutenyl ($\overline{M}_n$~1500) substituted succinic anhydride with pentaerythritol and ethylene polyamine, 1.36% mixed primary/secondary dialkyl dithiophosphate, 0.12% nonylphenoxy polyethoxy-ethanol, 0.59% calcium overbased (MR~12) petroleum sulfonate, 0.32% magnesium overbased (MR~14.7) alkylbenzene sulfonate, 80 ppm silicone antifoam and the amounts of the components set forth in the following table:

| Component | Example (% by weight) | | |
|---|---|---|---|
| | XXIII | XXIV | XXV |
| Product of Example 6B | 8 | 9 | |
| Product of Example 8B | | | 8.1 |

Example XXVI

A lubricating composition as in Example XXIII except base oil is SAE 15W.

Example XXVII

A lubricating composition as in Example XXIV except base oil is SAE 15W.

Example XXVIII

A lubricating composition as in Example XXIII employing 7% by weight of the product of Example 6B.

Lubricating oil compositions are prepared by blending the ingredients set forth in the following table:

| Components/Example | XXIX | XXX |
|---|---|---|
| Base Oil | Exxon | Exxon |
| Grade | 5W-30 | 5W-30 |
| Product: Example 6-B | 9.5 | |
| Product: Example 8-B | | 9.5 |
| Polyisobutenyl succinic anhydride-ethylene polyamine reaction product | 3.01 | 1.58 |
| Zn secondary dialkyl dithiophosphate | 0.9 | 0.79 |
| Cu secondary dialkyl dithiophosphate | 0.08 | 0.07 |
| Ca overbased petroleum sulfonate, (MR-15) | 0.47 | |
| Ca overbased alkyl benzene sulfonate (MR 12) | | 0.44 |
| Mg overbased alkyl benzene sulfonate, (MR 14.7) | 0.17 | 0.08 |
| Mg overbased alkyl benzene sulfonate (MR 2.8) | 0.33 | 0.29 |
| Na overbased alkyl benzene sulfonate, (MR 20) | 0.30 | 0.26 |
| Sulfurized alkyl phenol | 0.29 | 0.28 |
| Styrene-maleate copolymer-neutralized with aminopropyl-morpholine | 0.08 | 0.08 |
| Fatty amide | 0.10 | 0.09 |
| Nonylphenoxy polyethoxy-ethanol | 0.11 | 0.10 |
| Silicone antifoam agent | 100 ppm | 62 ppm |

Example XXXI

A lubricating composition as in Example XXIX replacing 9.5% of the product of Example 6-B with 7.5% of the product of Example 8-B.

Example XXXII

A lubricating composition as in Example XXX replacing 9.5% of the product of Example 6-B with 7.5% of the product of Example 8-B.

Example XXXIII

A lubricating composition as in Example XXX employing 9% of the product of Example 6-B.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A dispersant-viscosity improver for lubricating oil compositions comprising the reaction product of reactants comprising (a) a hydrocarbon polymer grafted with an α,β-ethylenically unsaturated carboxylic acid or functional derivative thereof; and (b) at least one nitrogen and metal containing derivative of a hydrocarbon substituted polycarboxylic acid or functional derivative thereof selected from the group consisting of (b-i) amide and imide derivatives of metal salts and (b-ii) metal complexes of non-acidic acylated nitrogen compounds; and optionally, (c) at least one hydroxyl group-containing polyester containing at least one condensable free hydroxyl group.

2. The dispersant-viscosity improver of claim 1 wherein (b) is a basic amine complexed metal salt.

3. The dispersant-viscosity improver of claim 1 wherein (b-1) is a mixed metal carboxylate salt of an acylated amine.

4. The dispersant-viscosity improver of claim 1 wherein the reactants are free of (c) the hydroxyl group containing polyester.

5. The dispersant viscosity improver of claim 1 wherein (c) is present in amounts ranging from about 0.1 to about 4 equivalents based on —OH per carbonyl equivalent of (a).

6. The dispersant-viscosity improver of claim 1 wherein (a) is present in amounts ranging from about 0.1 to about 5 carboxyl equivalents of per equivalent based on total base number of (b).

7. The dispersant-viscosity improver of claim 6 wherein (a) is present in amounts ranging from about 0.1 to about 10 parts by weight per part by weight of (b).

8. The dispersant-viscosity improver of claim 1 wherein (c) is present in amounts ranging from about 0.1 to about 4 equivalents based on free OH per equivalent of (a).

9. The dispersant-viscosity improver of claim 1 wherein the hydrocarbon copolymer has a number average molecular weight ranging from about 20,000 to about 500,000.

10. The dispersant-viscosity improver of claim 1 wherein the hydrocarbon polymer is selected from the group consisting of (1) hydrogenated polymers of dienes;

(2) hydrogenated copolymers of a conjugated diene with one or more vinyl substituted aromatic compounds;

(3) polymers of alpha olefins containing from 2 to about 28 carbon atoms;

(4) olefin-diene copolymers; and (5) star polymers.

11. The dispersant-viscosity improver of claim 10 wherein the polymer is (1) a hydrogenated polymer of dienes wherein the dienes are conjugated dienes selected from the group consisting of 1,3-butadiene and isoprene.

12. The dispersant viscosity improver of claim 10 wherein the polymer is (2) a hydrogenated copolymer of a conjugated diene with one or more vinyl substituted aromatic compounds wherein the diene is an aliphatic diene.

13. The dispersant-viscosity improver of claim 12 wherein the vinyl substituted aromatic compound is selected from the group consisting of styrene, t-butyl styrene and α- and β- methyl styrenes.

14. The dispersant-viscosity improver of claim 12 wherein the diene is selected from the group consisting of isoprene and 1,3-butadiene.

15. The dispersant-viscosity improver of claim 10 wherein the polymer is (3) a polymer of alpha olefins containing from 2 to about 28 carbon atoms wherein the polymer is a copolymer of ethylene and an alpha olefin containing from 3 to 28 carbon atoms.

16. The dispersant viscosity improver of claim 15 wherein the polymer is a copolymer of ethylene and propylene.

17. The dispersant-viscosity improver of claim 10 wherein the polymer is (4) an olefin-diene copolymer wherein the olefin comprises a mixture of ethylene and propylene and the diene is a nonconjugated diene selected from the group consisting of 1,4-hexadiene, cyclopentadiene and ethylidene norbornene.

18. The dispersant-viscosity improver of claim 10 wherein the polymer is (5) a star polymer wherein the arms are selected from the group consisting of (a) hydrogenated polymers of conjugated diolefins and (b) hydrogenated polymers of conjugated dienes and vinyl substituted aromatic components.

19. The dispersant-viscosity improver of claim 1 wherein (c) is present and is a hydroxy-containing polyester of at least one hydrocarbon substituted monocarboxylic and dicarboxylic acid, said hydrocarbon substituent containing from 5 to about 500 carbon atoms.

20. The dispersant-viscosity improver of claim 1 wherein the hydroxy-containing polyester (c) has been post treated with about 0.2 to about 5 equivalents of an ethylene polyamine per carbonyl group in the polyester.

21. The dispersant-viscosity improver of claim 1 wherein the ethylenically unsaturated carboxylic acid or functional derivative thereof, is an α,β- unsaturated carboxylic acid or functional derivative thereof containing from 2 to about 20 carbon atoms exclusive of carbonyl carbons.

22. The dispersant-viscosity improver of claim 21 wherein the ethylenically unsaturated carboxylic acid or functional derivative thereof, comprises at least one member of the group consisting of maleic acid, maleic anhydride, fumaric acid, itaconic acid and itaconic anhydride and esters of the acids.

23. The dispersant-viscosity improver of claim 1 wherein grafting of the hydrocarbon copolymer is conducted at about 100° C. to about 200° C. in the presence of a free radical initiator.

24. The dispersant-viscosity improver of claim 1 wherein the metal in (b) is at least one member of the group consisting of alkali metals, alkaline earth metals, zinc, antimony, copper, titanium, cadmium, zirconium, lead, tin, antimony, cerium, and the lanthanides.

25. The dispersant-viscosity improver of claim 1 wherein the hydrocarbon substituent in (b) contains from about 8 to about 750 carbon atoms.

26. The dispersant-viscosity improver of claim 1 wherein the nitrogen moiety is derived from an amine selected from the group consisting of alkylene polyamines and hydroxyalkyl substituted alkylene polyamines having up to about 8 carbon atoms in the alkylene radical and up to about 6 carbon atoms in the hydroxy alkyl group.

27. The dispersant-viscosity improver of claim 26 wherein the alkylene radicals contain 2 or 3 carbon atoms.

28. The dispersant-viscosity improver of claim 27 wherein the amine comprises polyethylene polyamine bottoms.

29. The dispersant-viscosity improver of claim 1 wherein the hydrocarbon substituent in (b) contains from about 30 up to about 200 carbon atoms.

30. The dispersant-viscosity improver of claim 1 wherein the hydrocarbon substituent in (b) is a radical derived from polyisobutylene having a number average molecular weight ranging from about 300 to about 5,000.

31. The dispersant-viscosity improver of claim 30 wherein the number average molecular weight ranges from about 700 to about 2,000.

32. The dispersant-viscosity improver of claim 1 further containing boron.

33. A dispersant-viscosity improver for lubricating oil compositions comprising the reaction product of reactants comprising (a) a hydrocarbon polymer grafted with an α,β-ethylenically unsaturated carboxylic acid or functional derivative thereof; and (b) oil soluble amide and imide derivatives of hydrocarbon substituted succinic metal salt, wherein the metal is at least one member of the group consisting of alkali metals, alkaline earth metals, lead, cadmium, zinc, copper, zirconium, tin, antimony, and cerium; and optionally, (c) at least one hydroxy-containing polyester containing at least one free condensable hydroxyl group.

34. The dispersant-viscosity improver of claim 33 wherein (b) is prepared by reacting about two equivalents of a hydrocarbon substituted succinic acid or anhydride containing at least about 30 carbon atoms in the hydrocarbon substituent with about one equivalent of a basic metal reactant selected from the class consisting of alkali metal, alkaline earth metal, lead, cadmium, titanium, tin, antimony, cerium, copper, zirconium and zinc oxides, hydroxides, carbonates and lower alcoholates and the successive combination of an alkali metal hydroxide and an inorganic metal salt consisting of alkaline earth metal, lead, cadmium, and zinc halides and nitrates and from one to about five equivalents of an amine selected from the group consisting of alkylene polyamines and hydroxyalkyl substituted alkylene polyamines having up to about 8 carbon atoms in the alkylene radical and up to about six carbon atoms in the hydroxyalkyl group.

35. The dispersant-viscosity improver of claim 33 wherein (b) comprises a mixture of a metal salt of a hydrocarbon substituted succinic acid or functional derivative thereof wherein the metal is selected from the group consisting of alkali metals, alkaline earth metals, lead, cadmium, zinc, copper, zirconium, and at least one derivative of a hydrocarbon substituted succinic acid or functional derivative thereof with an amine containing at least one N—H group.

36. The dispersant viscosity improver of claim 33 wherein (b) is prepared by reacting one equivalent of a mono metal salt of a hydrocarbon substituted succinic acid with from about 1 to about 5 equivalents of an amine selected from the group consisting of alkylene polyamines and hydroxy alkyl substituted alkylene polyamines having up to eight carbon atoms in the alkylene radical and up to about 6 carbon atoms in the hydroxyalkyl group.

37. The dispersant-viscosity improver of claim 33 wherein (b) is prepared by reacting one equivalent of a hydrocarbon substituted succinic acid or anhydride with from 1 to about 5 equivalents of an amine selected from the group consisting of alkylene polyamines and hydroxy alkyl substituted alkylene polyamines having up to about 8 carbon atoms in the alkylene group and up to about 6 carbon atoms in the hydroxy alkyl group, heating to effect acylation, removing water to form an acylated amine then reacting the acylated polyamine with about one equivalent of a basic metal reactant selected from the class consisting of alkali metal, alkaline earth metal, lead, cadmium, copper, titanium, tin, antimony, cerium, zirconium and zinc oxides, hydroxides, carbonates and lower alcoholates and the successive combination of an alkali metal hydroxide and an inorganic metal salt consisting of alkaline earth metal, lead, cadmium, and zinc halides and nitrates.

38. The dispersant viscosity improver of claim 1 wherein (b) is a metal complex of a hydrocarbyl substituted succinic acid acylated nitrogen compound.

39. The dispersant-viscosity improver of claim 33 wherein the hydroxy-containing polyester (c) is present and is a succinic polyester.

40. The dispersant-viscosity improver of claim 19 wherein the hydroxy-containing polyester (c) has been post treated with about 0.2 to about 5 equivalents of an ethylene polyamine per carbonyl group in the polyester.

41. An additive concentrate comprising an inert normally liquid organic diluent and from about 4 to about 40 percent by weight of the dispersant-viscosity improver of claim 1.

42. A lubricating composition comprising a major amount of an oil of lubricating viscosity and a minor amount of the dispersant-viscosity improver of claim 1.

43. A lubricating composition comprising a major amount of an oil of lubricating viscosity and a minor amount of the additive concentrate of claim 41.

44. The additive concentrate of claim 41 further comprising from about 1% to about 8% by weight of at least one pour point depressant selected from the group consisting of polymethacrylates, alkylated naphthalenes, styrene or α-olefin/alkyl maleate, copolymers and fumarate- and maleate- ester/vinyl acetate copolymers.

45. A lubricating composition comprising a major amount of an oil of lubricating viscosity and a minor amount of the additive concentrate of claim 44.

46. The lubricating composition of claim 42 wherein the oil of lubricating viscosity is a synthetic oil.

47. The lubricating composition of claim 42 wherein the oil of lubricating viscosity is a mineral oil.

48. The lubricating composition of claim 46 wherein the synthetic oil is a polyalphaolefin oil.

49. The lubricating composition of claim 47 wherein the mineral oil is a hydrotreated naphthenic oil.

50. The lubricating composition of claim 42 wherein the oil of lubricating viscosity comprises a mixture of mineral oil and synthetic oil.

* * * * *